US009146500B2

(12) United States Patent
Uesugi et al.

(10) Patent No.: US 9,146,500 B2
(45) Date of Patent: Sep. 29, 2015

(54) DEVELOPER ACCOMMODATING UNIT

(71) Applicant: CANON KABUSHIKI KAISHA, Tokyo (JP)

(72) Inventors: Tetsuo Uesugi, Kawasaki (JP); Masaki Furutani, Tokyo (JP); Kojiro Yasui, Numazu (JP); Hiroomi Matsuzaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/017,340

(22) Filed: Sep. 4, 2013

(65) Prior Publication Data

US 2014/0072329 A1 Mar. 13, 2014

(30) Foreign Application Priority Data

Sep. 10, 2012 (JP) ..... 2012-198090

(51) Int. Cl.
*G03G 15/08* (2006.01)

(52) U.S. Cl.
CPC ..... *G03G 15/0874* (2013.01)

(58) Field of Classification Search
CPC ..... G03G 15/0874
USPC ..... 399/106, 105, 103
See application file for complete search history.

(56) References Cited

U.S. PATENT DOCUMENTS 4,998,140 A * 3/1991 Satou et al. ..... 399/105
5,075,727 A * 12/1991 Nakatomi ..... 399/103
5,943,529 A 8/1999 Miyabe et al.
5,966,567 A 10/1999 Matsuzaki et al.
6,011,941 A 1/2000 Takashima et al.
6,097,906 A 8/2000 Matsuzaki et al.
6,144,815 A 11/2000 Chadani et al.
6,173,140 B1 1/2001 Suzuki et al.
6,173,145 B1 1/2001 Chadani et al.
6,205,305 B1 3/2001 Suzuki et al.
6,219,504 B1 4/2001 Matsuzaki et al.
6,282,389 B1 8/2001 Matsuzaki et al.
6,405,004 B2 6/2002 Matsuzaki et al.
6,549,736 B2 4/2003 Miyabe et al.
6,681,088 B2 1/2004 Kanno et al.
6,792,229 B2 9/2004 Matsuzaki
6,795,666 B2 9/2004 Miyabe et al.
6,859,629 B2 2/2005 Miura et al.
6,931,226 B2 8/2005 Chadani et al.
6,934,485 B2 8/2005 Miyabe et al.
6,978,100 B2 12/2005 Yasui et al.

(Continued)

FOREIGN PATENT DOCUMENTS

JP 4-66980 A 3/1992

*Primary Examiner* — Rodney Bonnette
(74) *Attorney, Agent, or Firm* — Fitzpatrick, Cella, Harper & Scinto

(57) ABSTRACT

A developer accommodating unit for accommodating a developer includes a flexible container, provided with an opening for permitting discharge of the developer, for accommodating the developer, and a frame. The flexible container is provided with a fastening hole for fastening said flexible container in said frame. The frame includes a fixing shaft portion fixed in the fastening hole by being inserted into the fastening hole, and includes a retaining portion for preventing the fixing shaft portion from being disengaged from the fastening hole. The fastening hole is locked by fitting the fastening hole around the fixing shaft portion while an edge of the fastening hole rides over the retaining portion by elastic deformation thereof.

17 Claims, 26 Drawing Sheets

(56) References Cited

U.S. PATENT DOCUMENTS

| | | | | |
|---|---|---|---|---|
| 7,016,626 | B2 | 3/2006 | Yokomori et al. | |
| 7,068,965 | B2 | 6/2006 | Yoshino et al. | |
| 7,085,516 | B2 | 8/2006 | Kawai et al. | |
| 7,155,137 | B2 | 12/2006 | Yasui et al. | |
| 7,224,925 | B2 | 5/2007 | Sato et al. | |
| 7,349,657 | B2 | 3/2008 | Sato et al. | |
| 7,412,193 | B2 | 8/2008 | Sato et al. | |
| 2005/0053393 | A1* | 3/2005 | Harada et al. | 399/106 |
| 2012/0099902 | A1* | 4/2012 | Yoshida et al. | 399/262 |
| 2013/0136489 | A1 | 5/2013 | Yamaguchi et al. | |
| 2013/0164039 | A1* | 6/2013 | Matsushita et al. | 399/258 |
| 2013/0164040 | A1* | 6/2013 | Matsushita et al. | 399/258 |
| 2013/0308973 | A1* | 11/2013 | Kashiide et al. | 399/106 |
| 2013/0308979 | A1* | 11/2013 | Matsuzaki et al. | 399/111 |
| 2013/0322926 | A1* | 12/2013 | Matsunaga et al. | 399/258 |
| 2013/0336679 | A1 | 12/2013 | Furutani et al. | |
| 2013/0343785 | A1 | 12/2013 | Matsuzaki et al. | |
| 2014/0016961 | A1 | 1/2014 | Yasui et al. | |
| 2014/0029974 | A1 | 1/2014 | Uesugi et al. | |
| 2014/0064793 | A1 | 3/2014 | Matsuzaki et al. | |
| 2014/0072330 | A1 | 3/2014 | Yoshida et al. | |
| 2014/0072345 | A1 | 3/2014 | Matsunaga et al. | |
| 2014/0072346 | A1 | 3/2014 | Furutani et al. | |
| 2014/0072347 | A1 | 3/2014 | Furutani et al. | |
| 2014/0079432 | A1 | 3/2014 | Matsuzaki et al. | |

* cited by examiner (a)

(b)

DEVELOPER ACCOMMODATING UNIT

FIELD OF THE INVENTION AND RELATED ART

The present invention relates to a developer accommodating unit to be used in an image forming apparatus.

As the image forming apparatus for forming an image on a sheet by using an electrophotographic image forming process, there are, e.g., an electrophotographic copying machine and an electrophotographic printer (such as LED (light emitting diode) printer or laser beam printer). Further, an electrophotographic facsimile machine and the like are used.

To the image forming apparatus, a cartridge in which a developer is accommodated is provided so as to be detachably mountable. Here, the cartridge refers to a cartridge which is constituted integrally with a developing device at least accommodating a developing means and the developer and which is made detachably mountable to an image forming apparatus main assembly or a cartridge which is constituted integrally with the developing device and a photosensitive member unit at least including a photosensitive member and which is made detachably mountable to the image forming apparatus main assembly.

Further, the developer accommodating unit is to be accommodated in the image forming apparatus or the cartridge. The developer accommodating unit includes at least a flexible container for accommodating the developer.

In a conventional electrophotographic image forming apparatus using the electrophotographic image forming process, a process cartridge type in which an electrophotographic photosensitive member and process means actable thereon are integrally assembled into a cartridge and the cartridge is made detachably mountable to an electrophotographic image forming apparatus main assembly has been employed.

In such a process cartridge, as described in Japanese Laid-Open Patent Application (JP-A) Hei 4-66980, an opening provided in a developer accommodating frame for accommodating the developer (toner, carrier and the like) is sealed with a sealing member. Then, a bonding portion of a toner seal member as the sealing member is peeled off during use to permit supply of the developer. Such a type has been widely employed.

Further, in order to solve a problem such that the developer is scattered in the process cartridge in a developer filling step during manufacturing of the process cartridge, a flexible container used as an inside container has been proposed.

However, as a fixing method of the flexible container to the frame as described in JP-A Hei 4-66980, ultrasonic caulking for crushing a boss of the frame is used.

SUMMARY OF THE INVENTION

A principal object of the present invention is to provide a developer accommodating unit, a process cartridge and an image forming apparatus which are capable of fixing a flexible container to a frame by a simple method.

According to an aspect of the present invention, there is provided a developer accommodating unit for accommodating a developer, comprising: a flexible container, provided with an opening for permitting discharge of the developer, for accommodating the developer; and a frame, wherein said flexible container is provided with a fastening hole for fastening said flexible container in said frame, wherein the frame includes a fixing shaft portion fixed in the fastening hole by being inserted into the fastening hole and includes a retaining portion for preventing the fixing shaft portion from being disengaged from the fastening hole, and wherein the fastening hole is locked by fitting the fastening hole around the fixing shaft portion while an edge of the fastening hole rides over the retaining portion by elastic deformation thereof.

These and other objects, features and advantages of the present invention will become more apparent upon a consideration of the following description of the preferred embodiments of the present invention taken in conjunction with the accompanying drawings.

Figure 4:
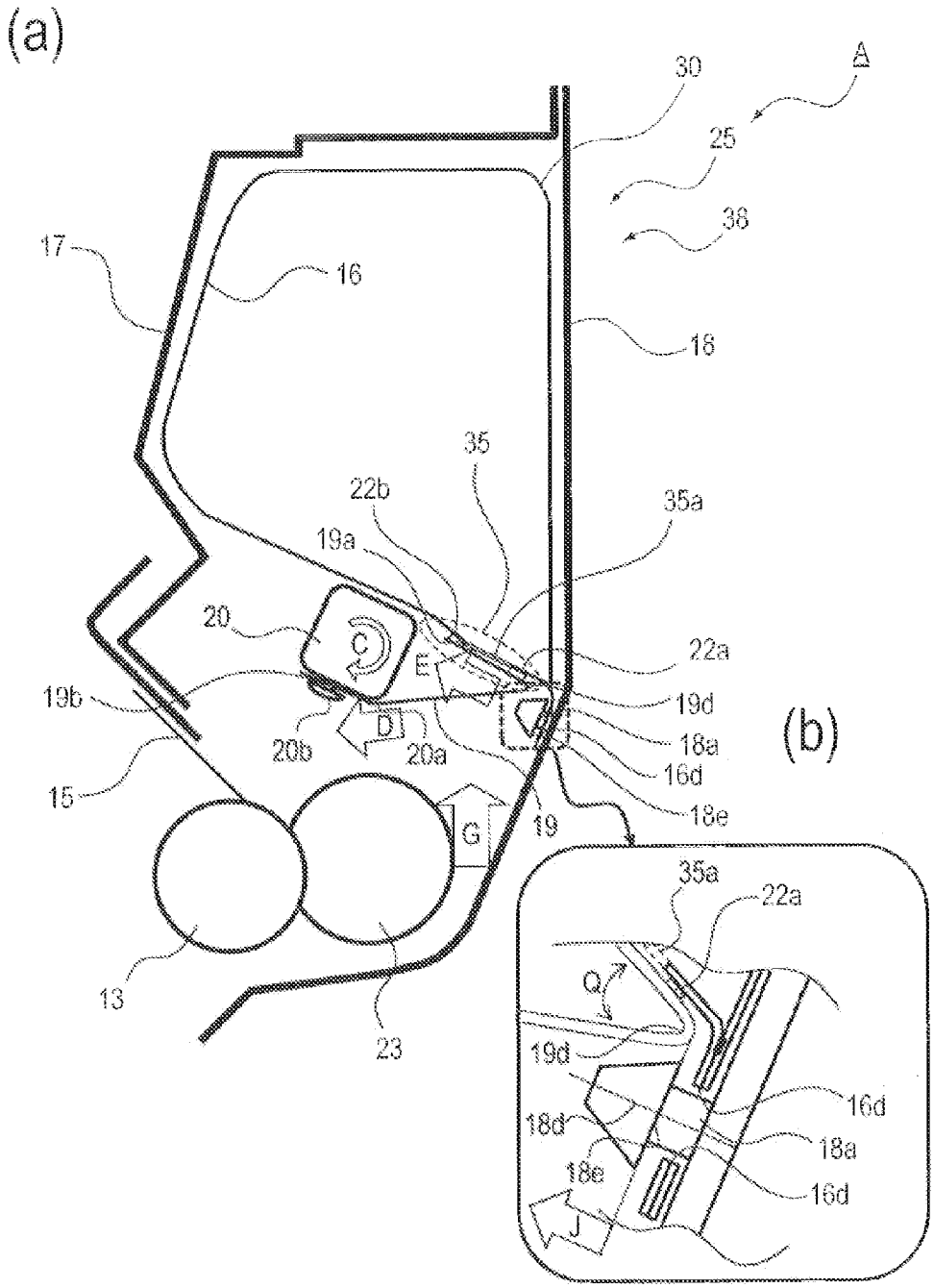

Part (a) of FIG. 4 is a sectional illustration showing a state before the unsealing in the developer accommodating unit in First Embodiment of the present invention, and (b) of FIG. 4 is a partly enlarged view of (a) of FIG. 4.

Figure 5:
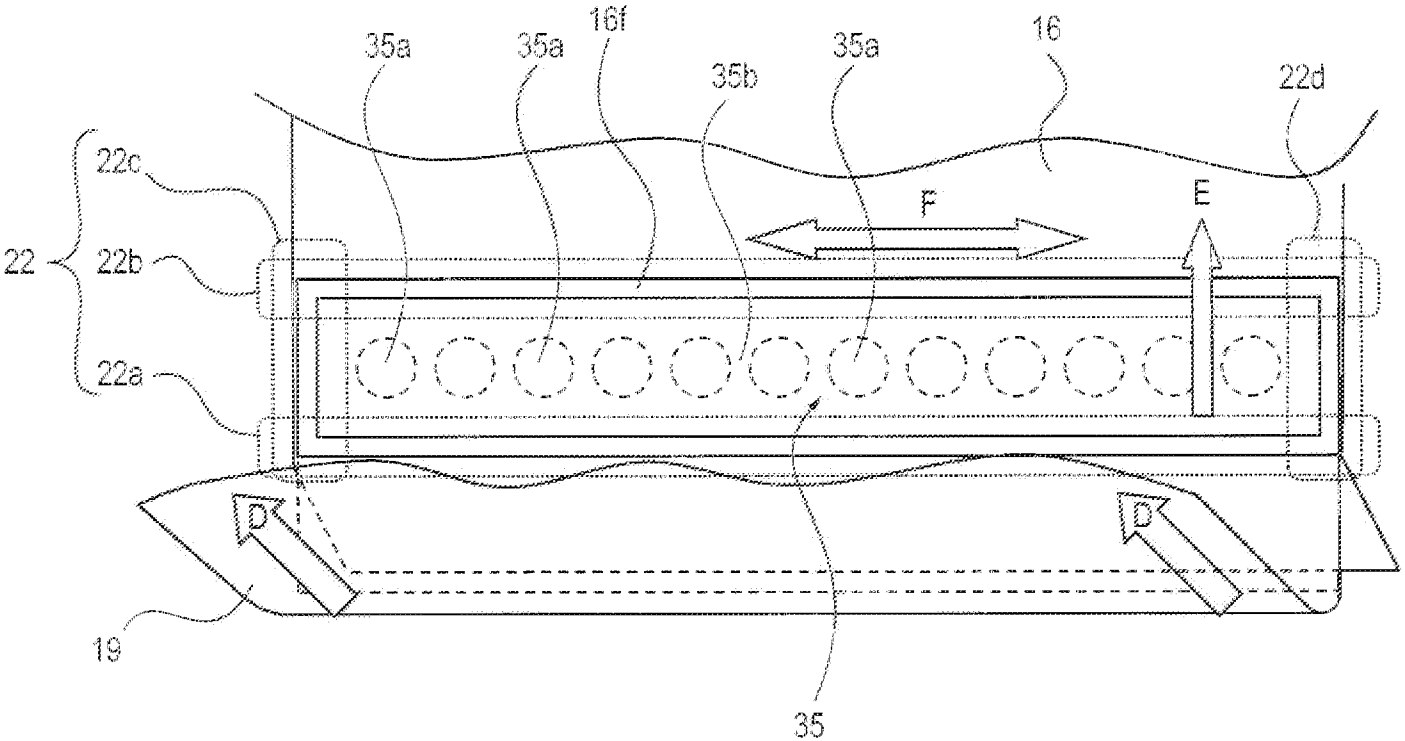

FIG. 5 is a perspective illustration showing a state before unsealing of a developer accommodating container in First Embodiment.

Figure 6:
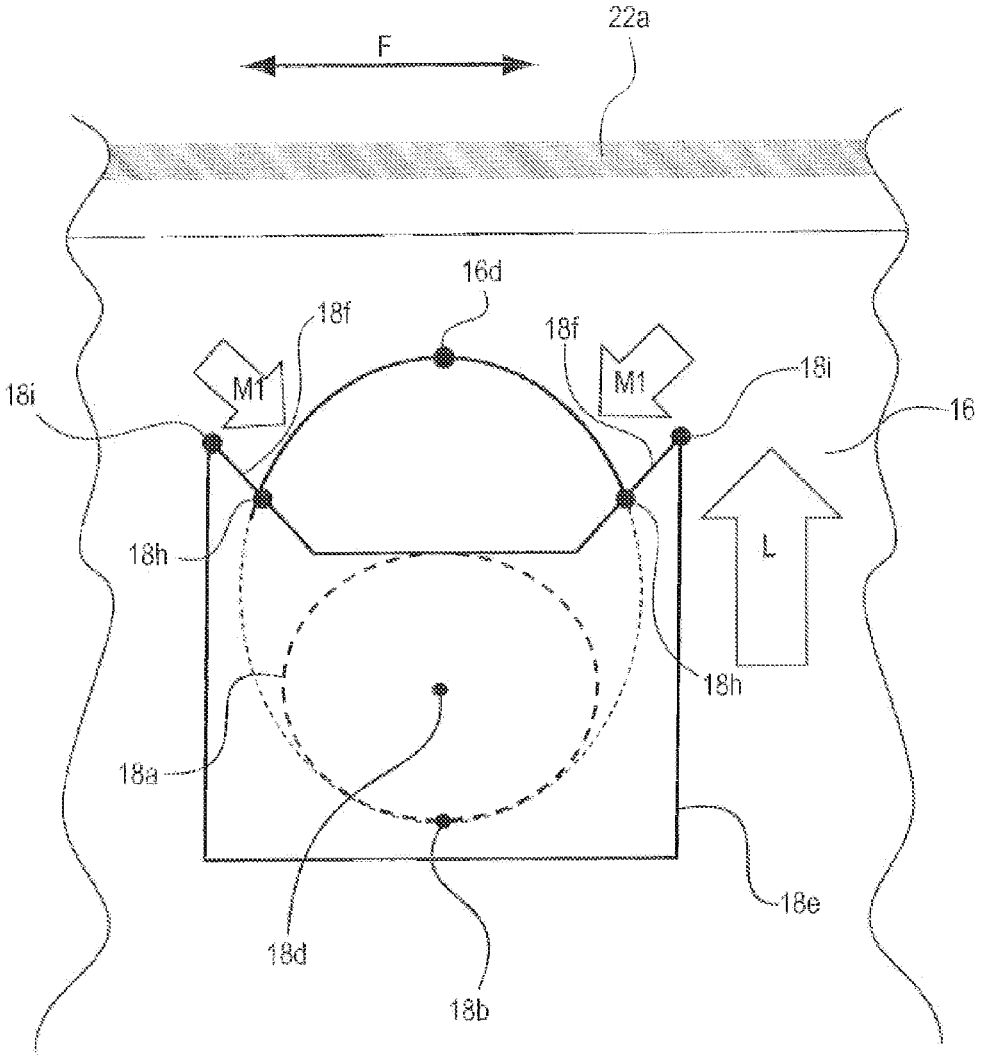

FIG. 6 is an illustration of a retaining portion in First Embodiment as seen by projecting the retaining portion on a plane perpendicular to an axis of a fixing shaft portion.

Figure 7:
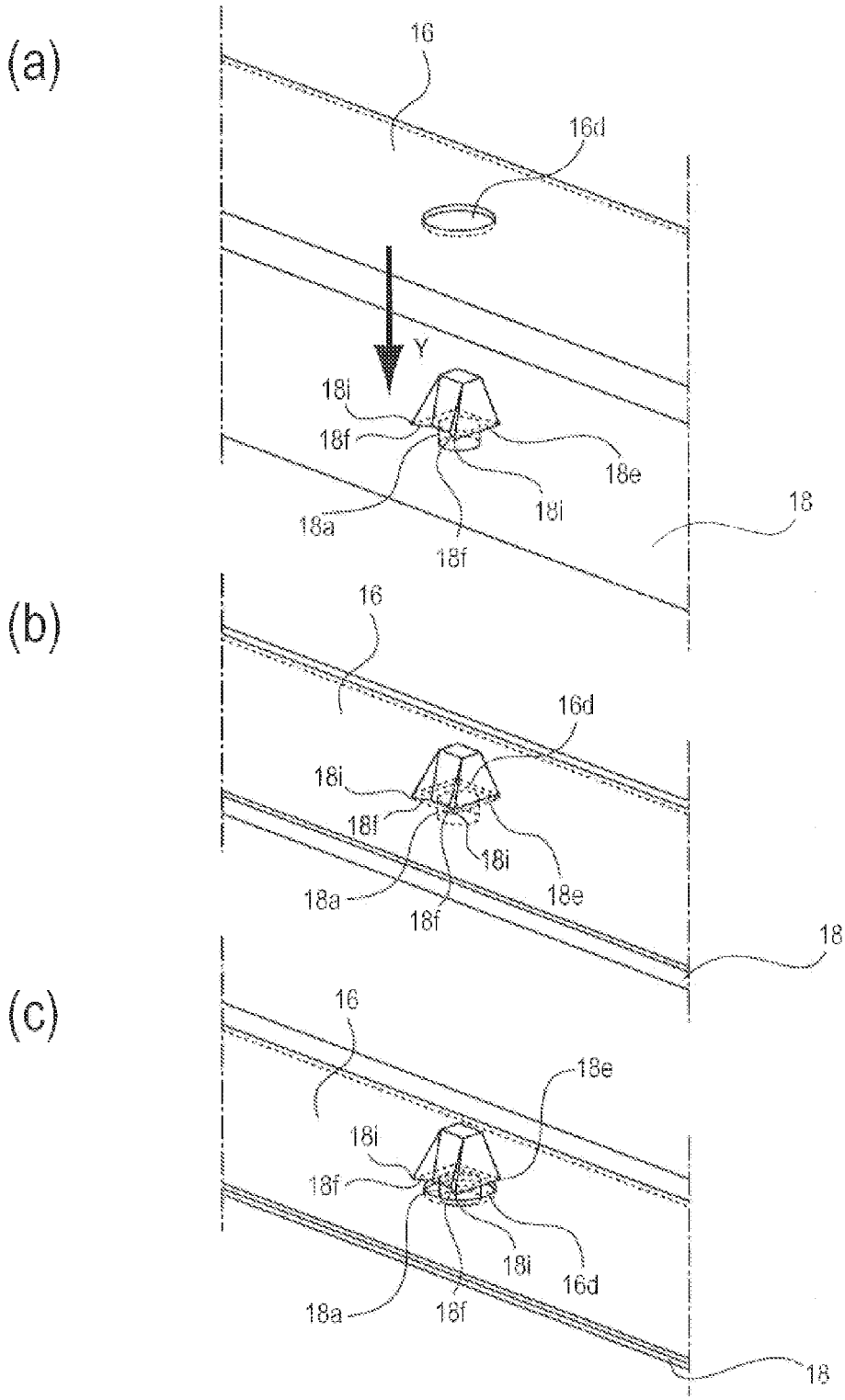

Parts (a) to (c) of FIG. 7 are perspective views for illustrating a state in which an edge portion of a fastening hole rides over the retaining portion by its elastic deformation to lock the fastening hole by the fixing shaft portion inserted into the fastening hole in First Embodiment.

Figure 8:
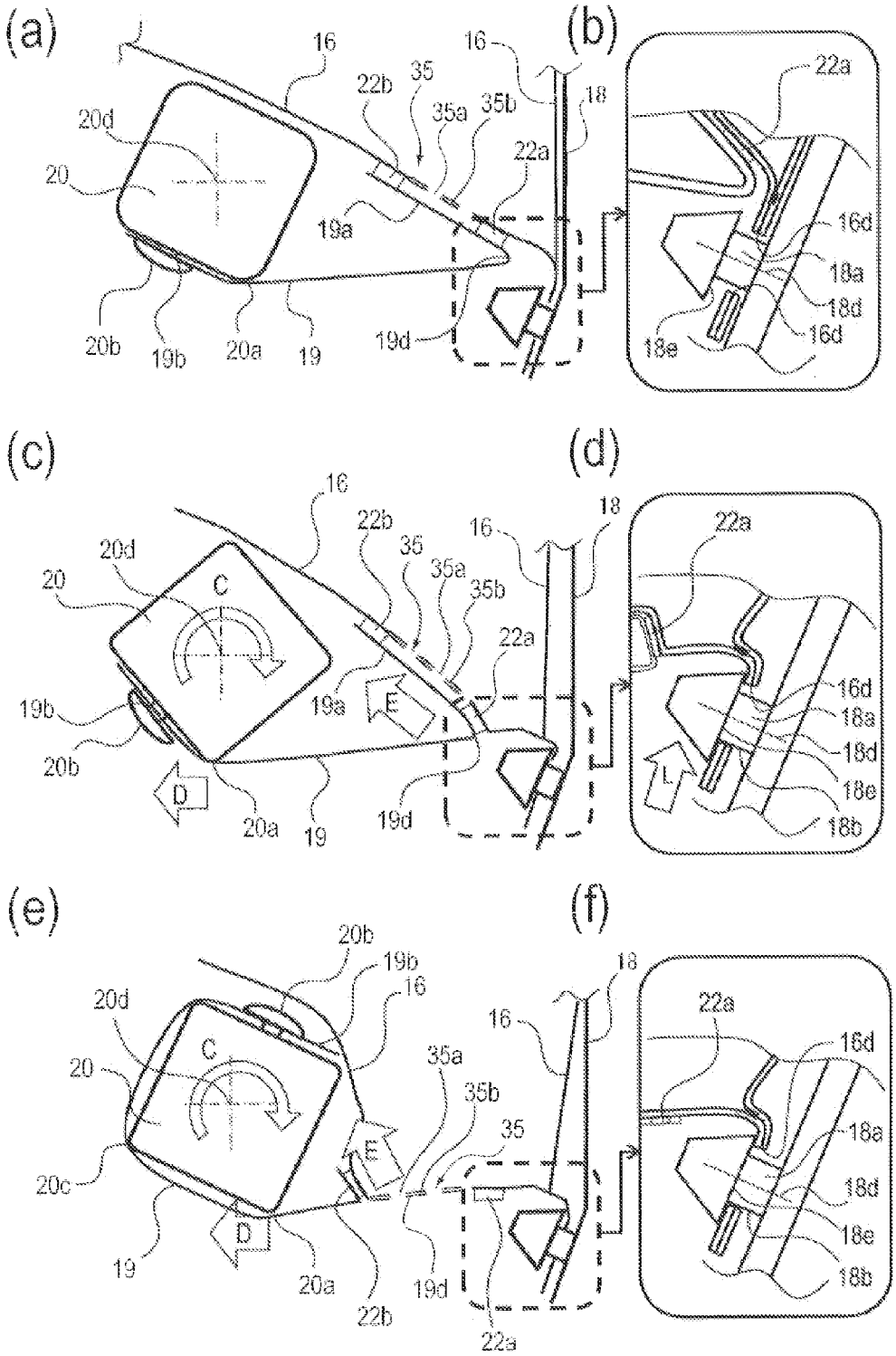

Parts (a), (c) and (e) of FIG. 8 are sectional views for illustrating an unsealing process of the opening of the flexible container by the unsealing member in First Embodiment, and (b), (d) and (f) of FIG. 8 are partly enlarged views of (a), (c) and (e) of FIG. 8, respectively.

Figure 9:
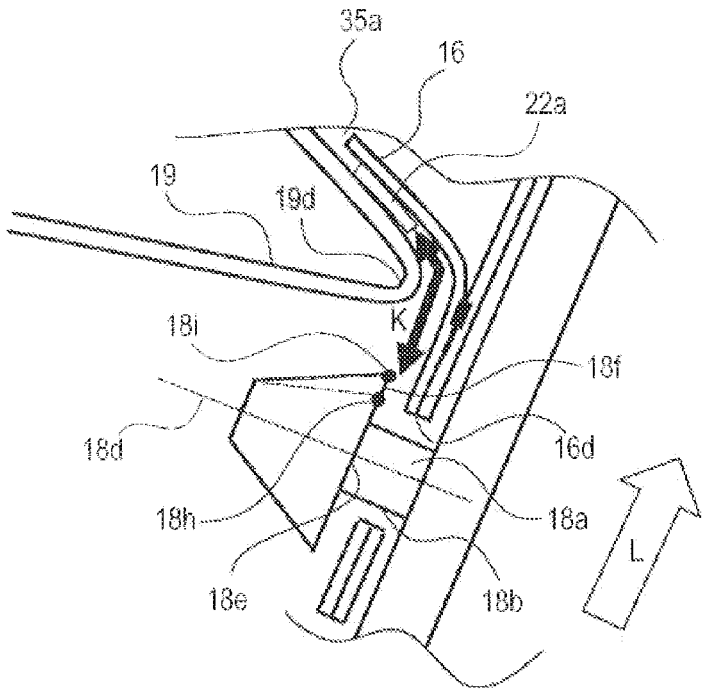
Figure 9:
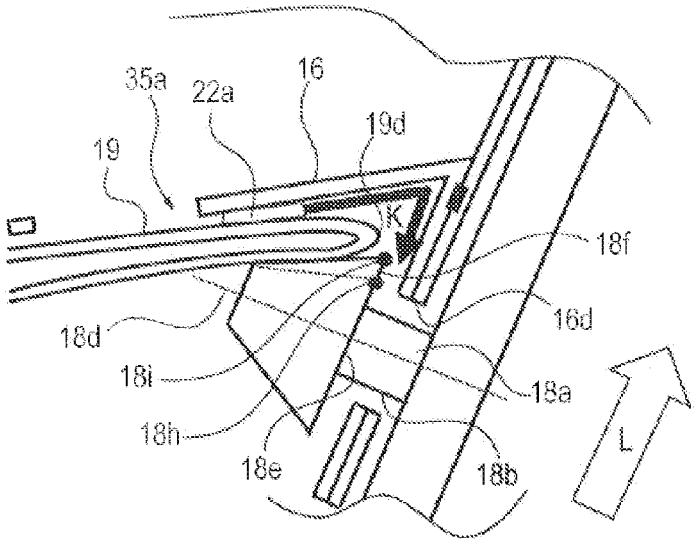

Part (a) of FIG. 9 is a sectional illustration showing a (spacing) distance between the retaining portion and a first bonding portion on a movement path in First Embodiment, and (b) of FIG. 9 is a sectional illustration showing a distance between the retaining portion and the first bonding portion on the movement path in the case where a shape of a developing bag having flexibility is deformed.

Figure 10:
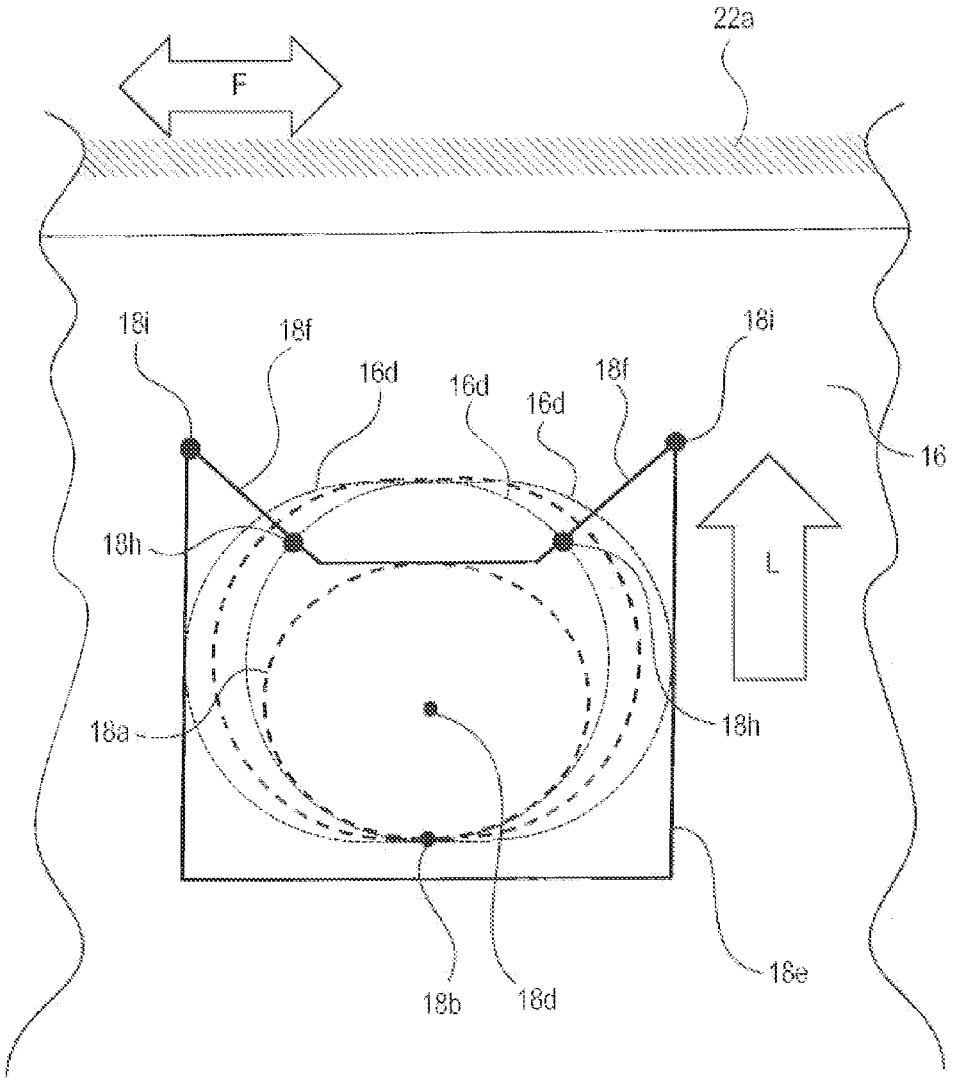

FIG. 10 is a schematic view of the retaining portion in First Embodiment as seen by projecting the retaining portion on the plane perpendicular to the axis of the fixing shaft portion, and is an illustration showing a state in which an outer end portion of a locking edge line outside an edge portion of a fastening hole has a distance closer to the first bonding portion than a locking portion where the edge portion of the fastening hole is locked.

Figure 11:
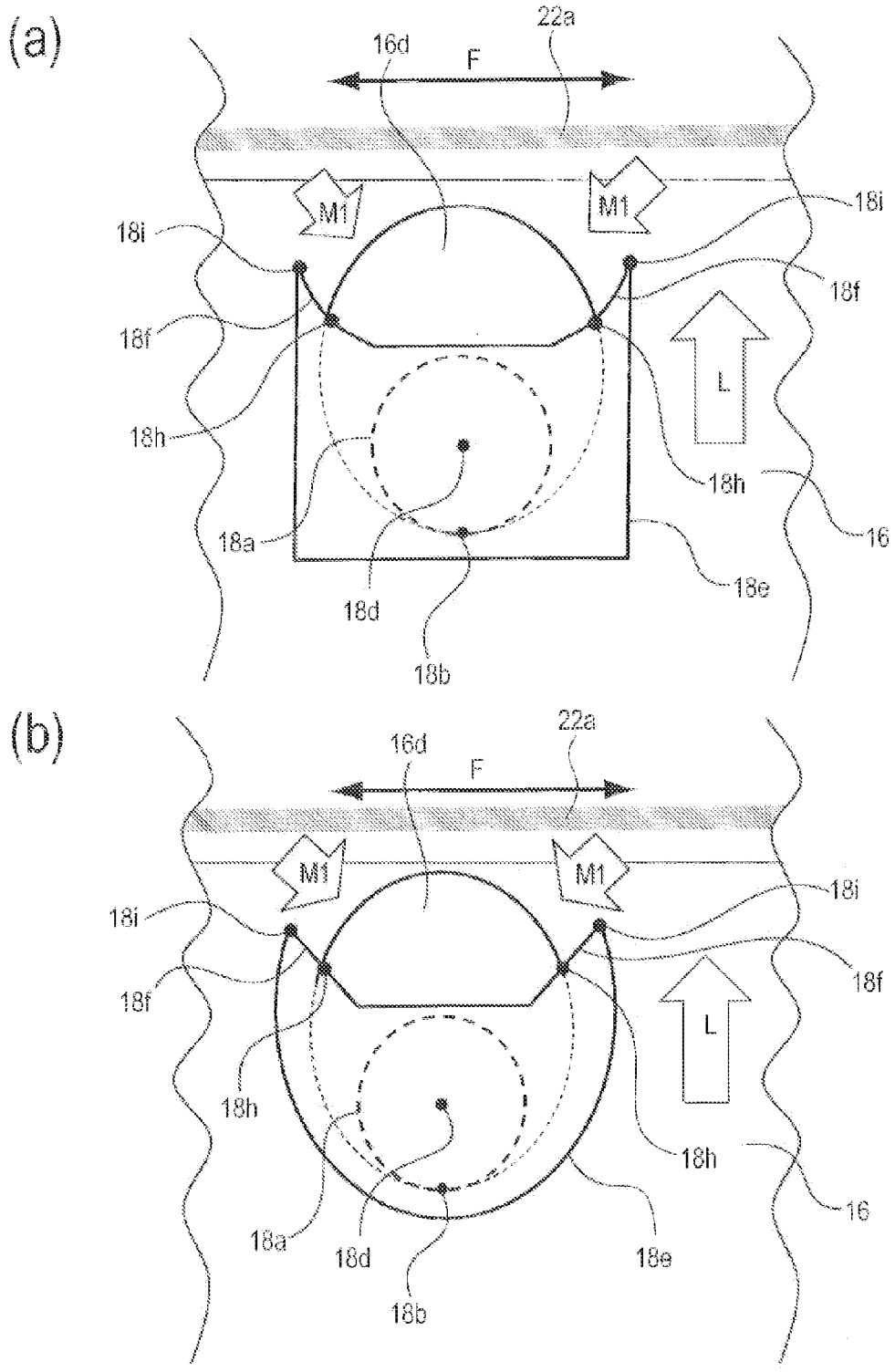

Part (a) of FIG. 11 is a schematic view of a retaining portion of a developer accommodating unit according to the present invention in Second Embodiment as seen by projecting the retaining portion on a plane perpendicular to an axis of a fixing shaft portion, and is an illustration showing a state in which an outer end portion of a locking edge line outside an edge portion of a fastening hole has a distance closer to the first bonding portion than a locking portion where the edge portion of the fastening hole is locked, and (b) of FIG. 11 is a schematic view of a retaining portion of a developer accommodating unit according to the present invention in Third Embodiment as seen by projecting the retaining portion on a plane perpendicular to an axis of a fixing shaft portion, and is an illustration showing a state in which an outer end portion of a locking edge line outside an edge portion of a fastening hole has a distance closer to the first bonding portion than a locking portion where the edge portion of the fastening hole is locked.

Figure 12:
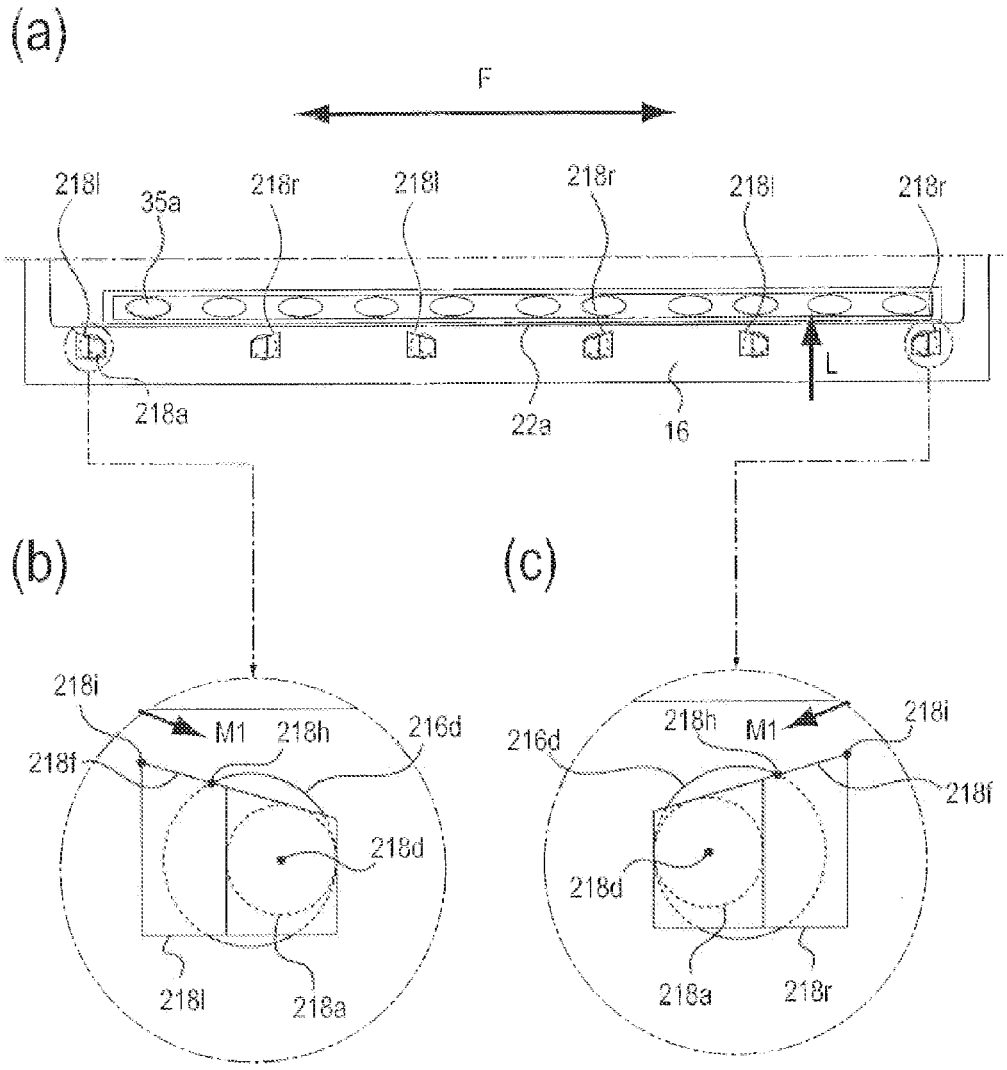

Part (a) of FIG. 12 is a schematic view of a retaining portion of a developer accommodating unit according to the present invention in Fourth Embodiment as seen by projecting the retaining portion on a plane perpendicular to an axis of a fixing shaft portion, and is an illustration showing a state in which an outer end portion of a locking edge line outside an edge portion of a fastening hole has a distance closer to the first bonding portion than a locking portion where the edge portion of the fastening hole is locked, and (b) and (c) of FIG. 12 are partly enlarged views of (a) of FIG. 12.

Figure 13:
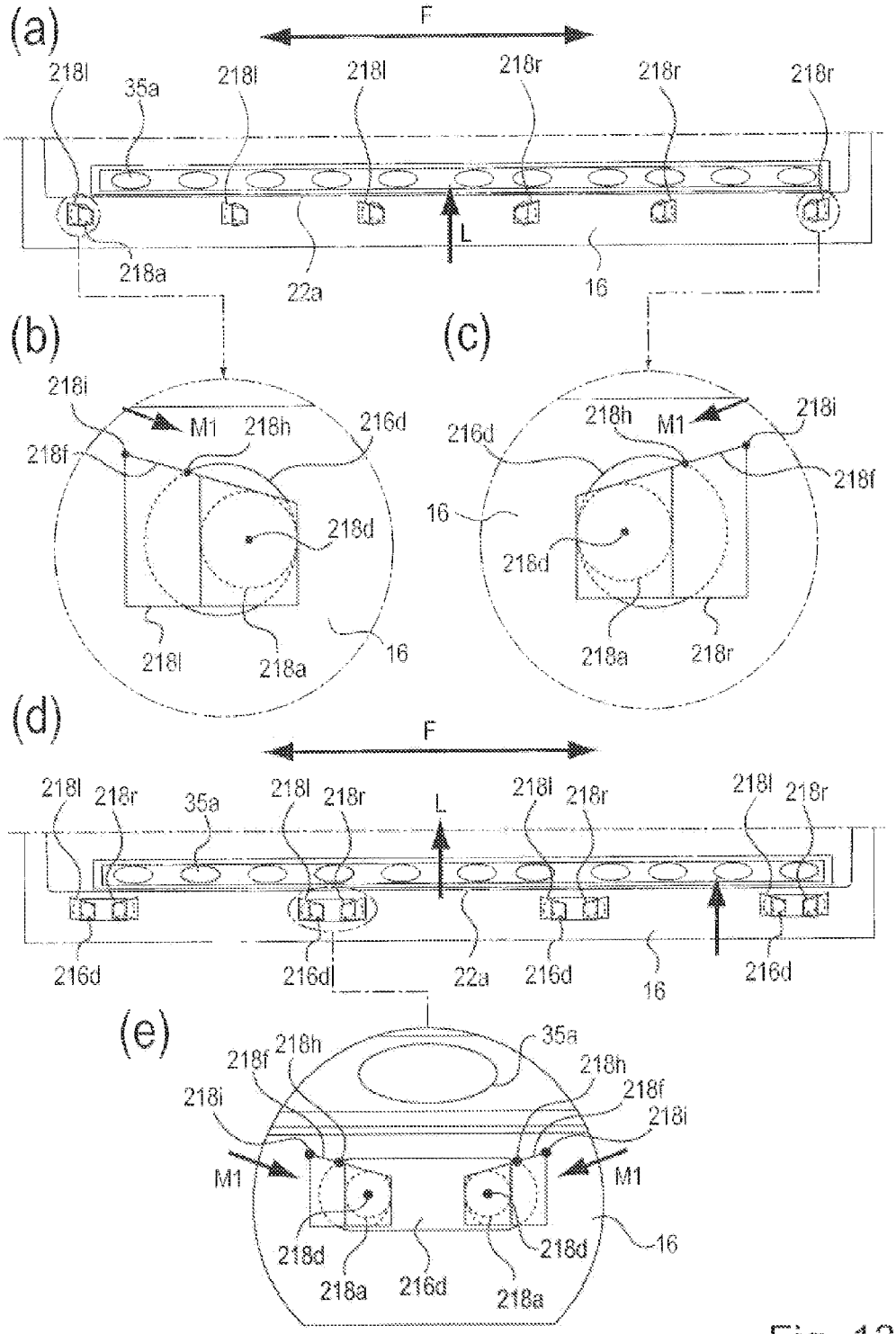

Part (a) of FIG. 13 is a schematic view of a retaining portion of a developer accommodating unit according to the present invention in Fifth Embodiment as seen by projecting the retaining portion on a plane perpendicular to an axis of a fixing shaft portion, and is an illustration showing a state in which an outer end portion of a locking edge line outside an edge portion of a fastening hole has a distance closer to the first bonding portion than a locking portion where the edge portion of the fastening hole is locked, and (b) and (c) of FIG. 13 are partly enlarged views of (a) of FIG. 13. Part (d) of FIG. 13 is a schematic view of a retaining portion of a developer accommodating unit according to the present invention in Sixth Embodiment as seen by projecting the retaining portion on a plane perpendicular to an axis of a fixing shaft portion, and is an illustration showing a state in which an outer end portion of a locking edge line outside an edge portion of a fastening hole has a distance closer to the first bonding portion than a locking portion where the edge portion of the fastening hole is locked, and (e) of FIG. 13 is a partly enlarged view of (d) of FIG. 13.

Figure 14:
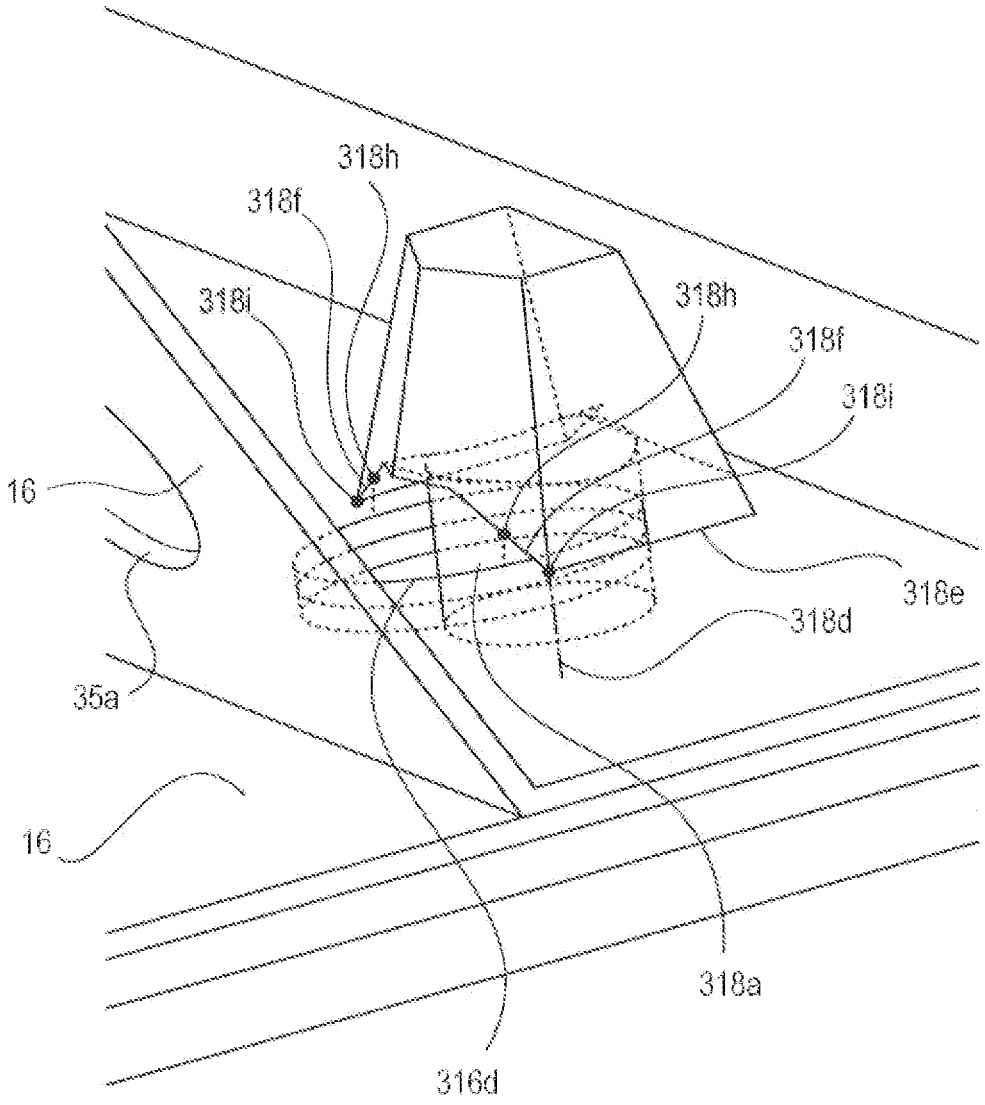

FIG. 14 is a perspective illustration showing a state in which in a developer accommodating unit according to the present invention in Seventh Embodiment, an outer end portion, of a locking edge line of a retaining portion, outside an edge portion of a fastening hole is projected toward the fastening hole, with respect to an axial direction of a fixing shaft portion, more than a locking portion where the edge portion of the fastening hole is locked.

Figure 15:
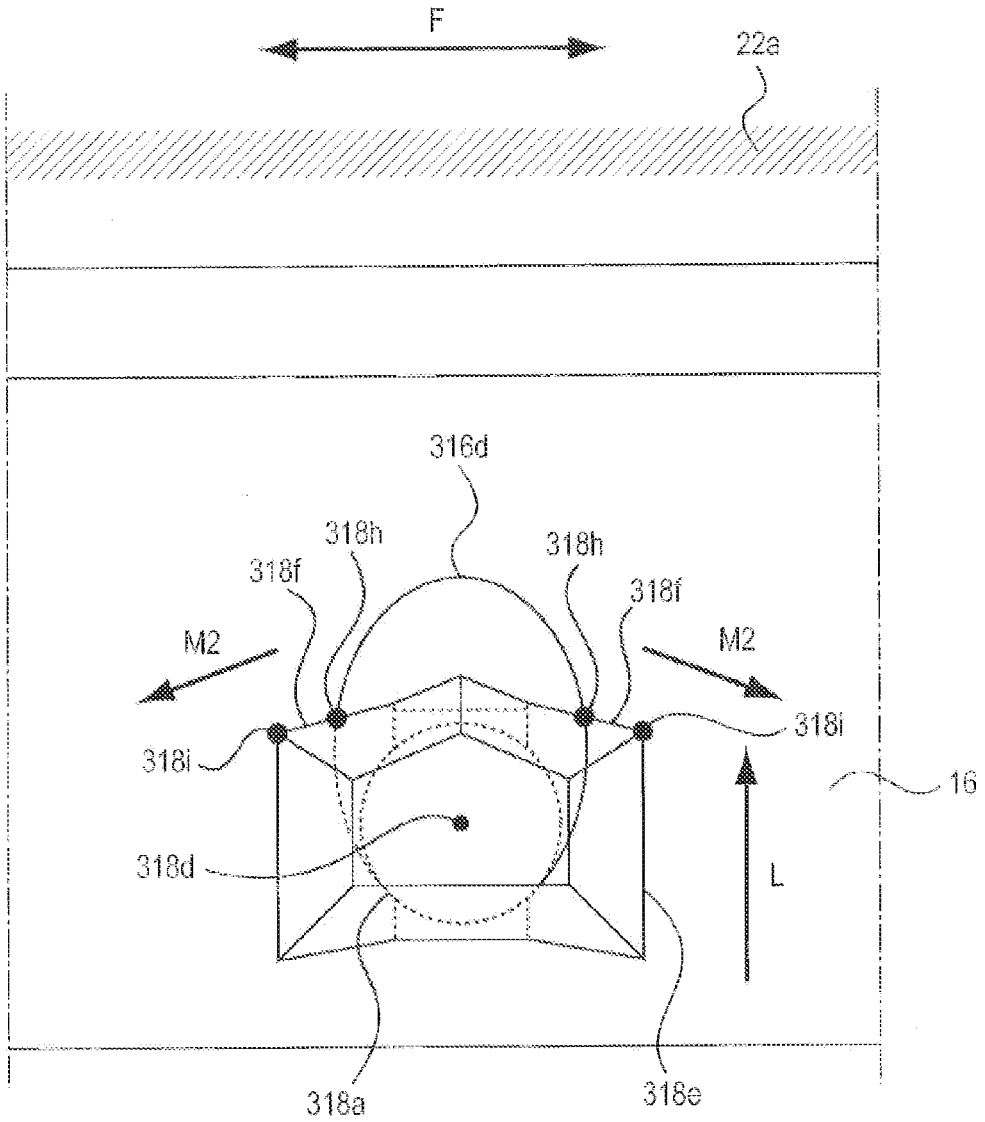

FIG. 15 is an illustration showing a state of the retaining portion in Seventh Embodiment as seen by projecting the retaining portion on a plane perpendicular to an axis of the fixing shaft portion.

Figure 16:
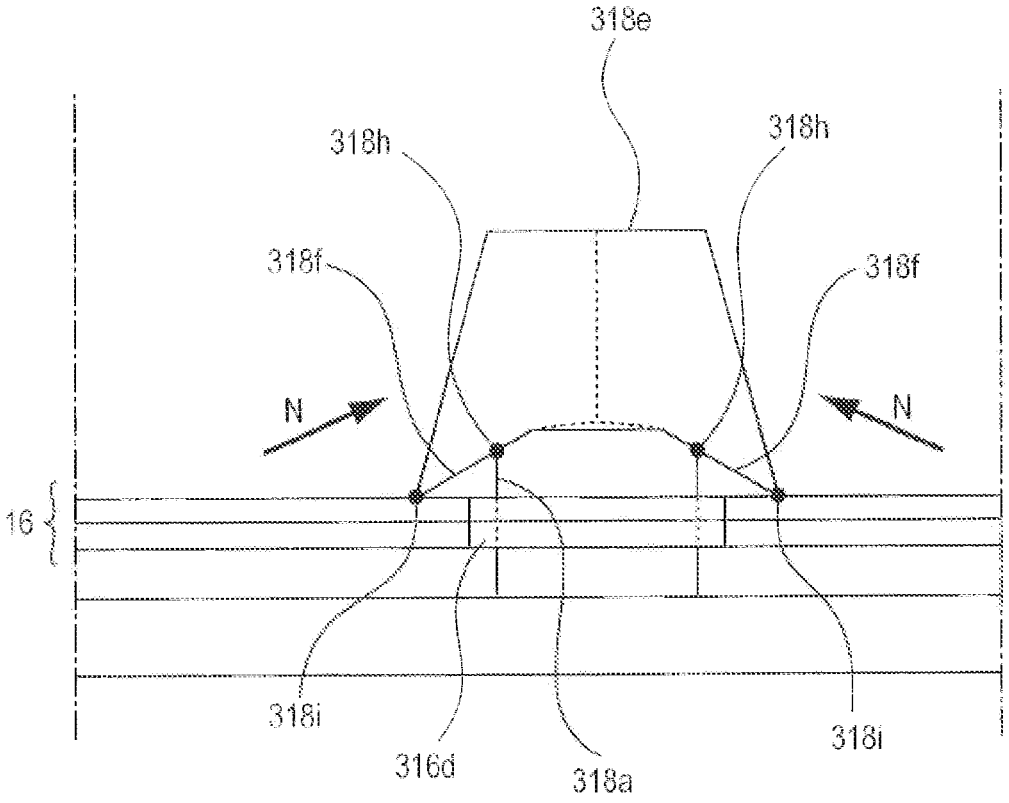

FIG. 16 is a sectional illustration showing a state in which, an outer end portion, of a locking edge line of a retaining portion, outside an edge portion of a fastening hole is projected toward the fastening hole, with respect to an axial direction of a fixing shaft portion, more than a locking portion where the edge portion of the fastening hole is locked in Seventh Embodiment.

Figure 17:
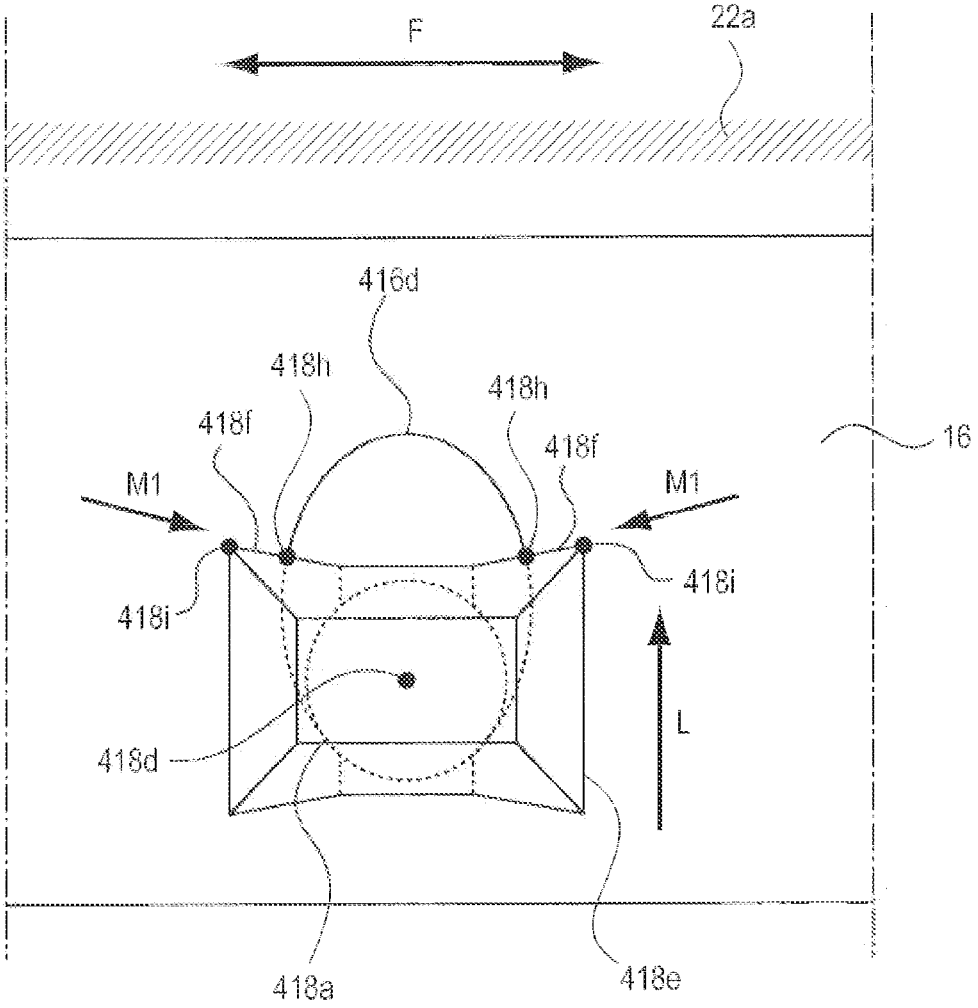

FIG. 17 is a schematic view of a retaining portion of a developer accommodating unit according to the present invention in Eighth Embodiment as seen by projecting the retaining portion on a plane perpendicular to an axis of a fixing shaft portion, and is an illustration showing a state in which an outer end portion of a locking edge line outside an edge portion of a fastening hole has a distance closer to the first bonding portion than a locking portion where the edge portion of the fastening hole is locked.

Figure 18:
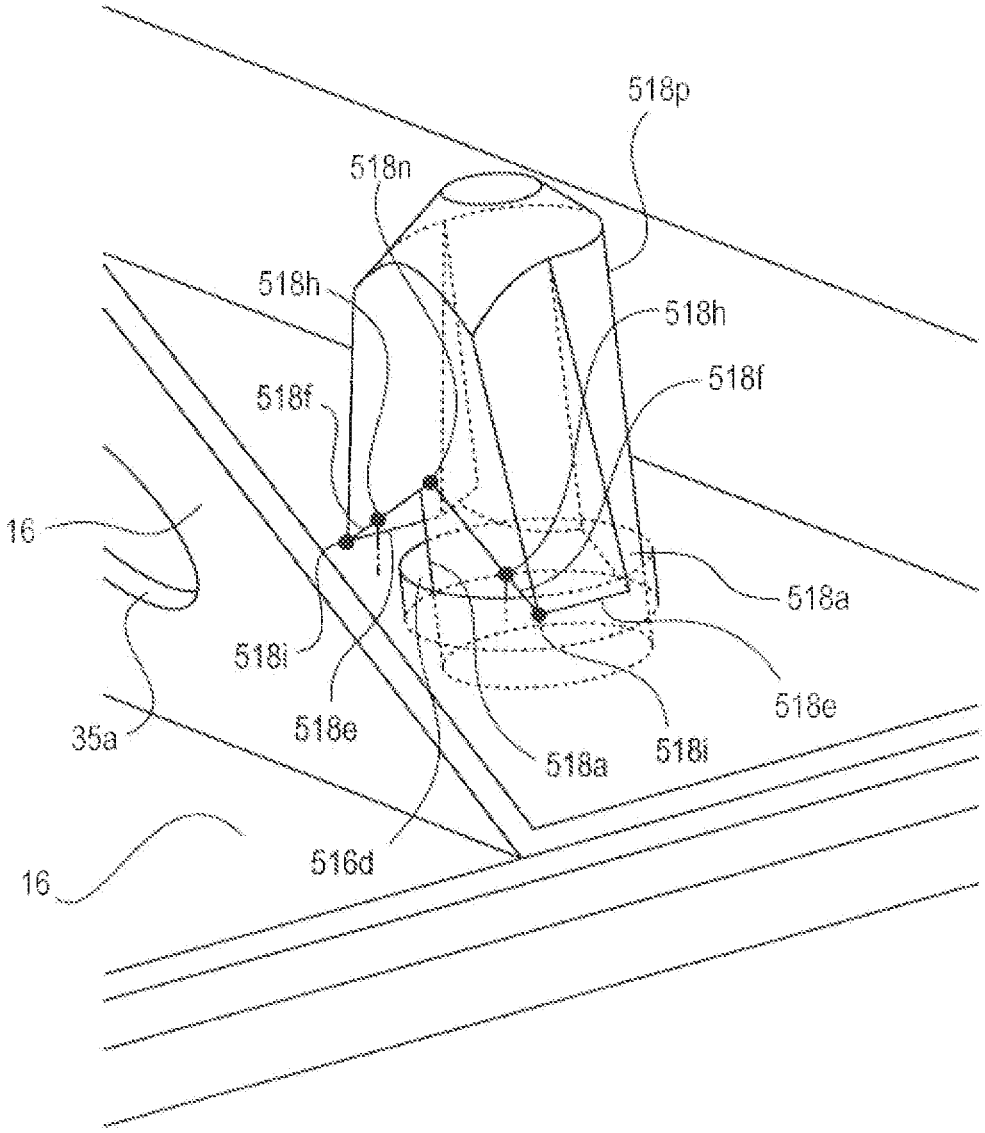

FIG. 18 is a perspective illustration showing a state in which in a developer accommodating unit according to the present invention in Ninth Embodiment, an outer end portion, of a locking edge line of a retaining portion, outside an edge portion of a fastening hole is projected toward the fastening hole, with respect to an axial direction of a fixing shaft portion, more than a locking portion where the edge portion of the fastening hole is locked.

Figure 19:
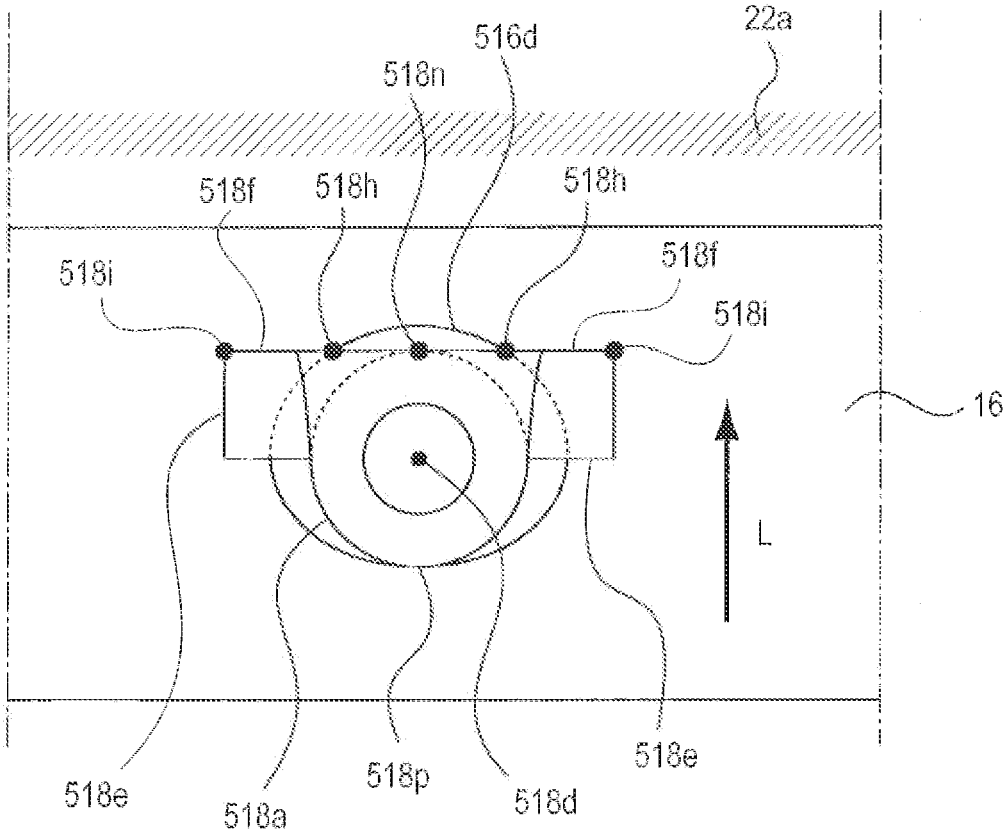

FIG. 19 is a schematic view of a retaining portion in Ninth Embodiment as seen by projecting the retaining portion on a plane perpendicular to an axis of a fixing shaft portion, and is an illustration showing a state in which an outer end portion of a locking edge line outside an edge portion of a fastening hole and a locking portion where the edge portion of the fastening hole is locked have the same distance to the first bonding portion and in which an outer peripheral surface of the fixing shaft portion and the locking edge line of the retaining portion contact each other.

Figure 20:
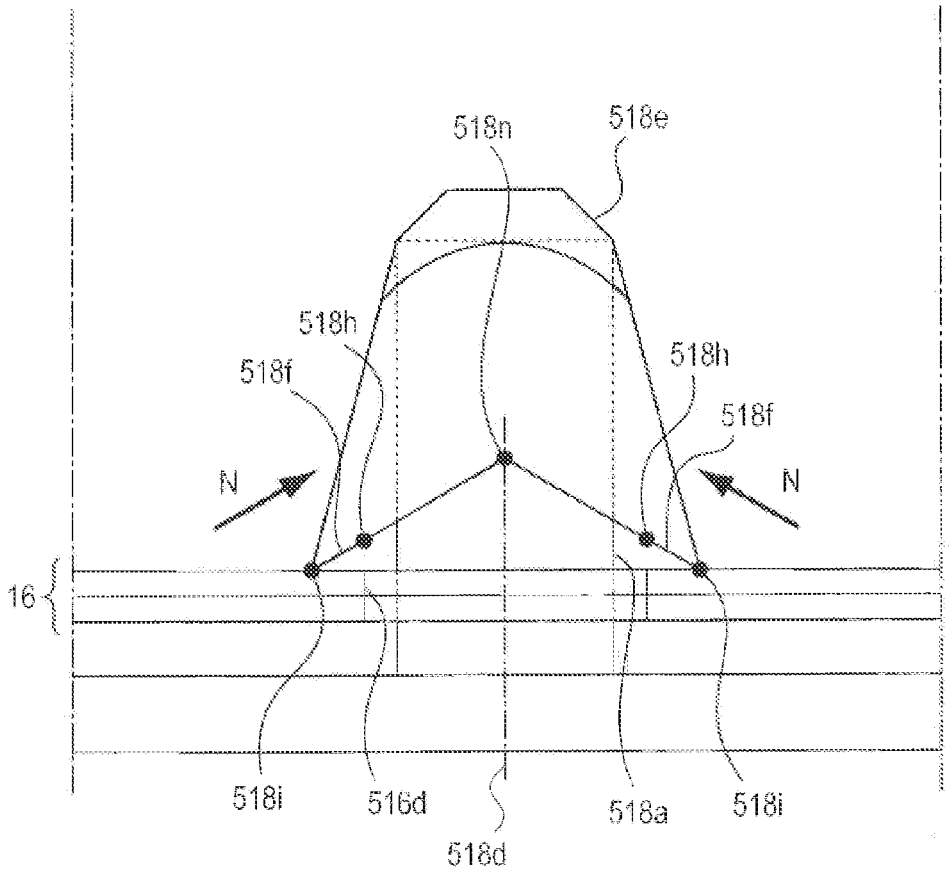

FIG. 20 is a sectional illustration showing a state in which, an outer end portion, of a locking edge line of a retaining portion, outside an edge portion of a fastening hole is projected toward the fastening hole, with respect to an axial direction of a fixing shaft portion, more than a locking portion where the edge portion of the fastening hole is locked in Ninth Embodiment.

Figure 21:
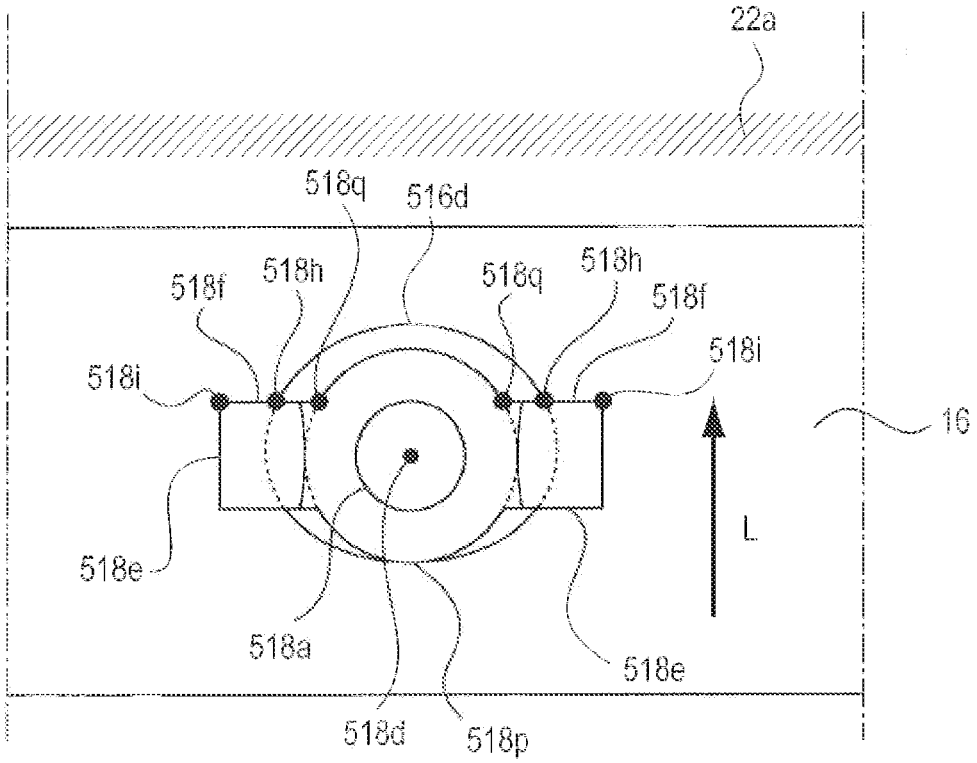

FIG. 21 is a schematic view of a retaining portion of a developer accommodating unit according to the present invention in Tenth Embodiment as seen by projecting the retaining portion on a plane perpendicular to an axis of a fixing shaft portion, and is an illustration showing a state in which an outer end portion of a locking edge line outside an edge portion of a fixing and a locking portion where the edge portion of the fastening hole is locked have the same distance to the first bonding portion and in which an outer peripheral surface of the fixing shaft portion is projected from the locking edge line of the retaining portion.

Figure 22:
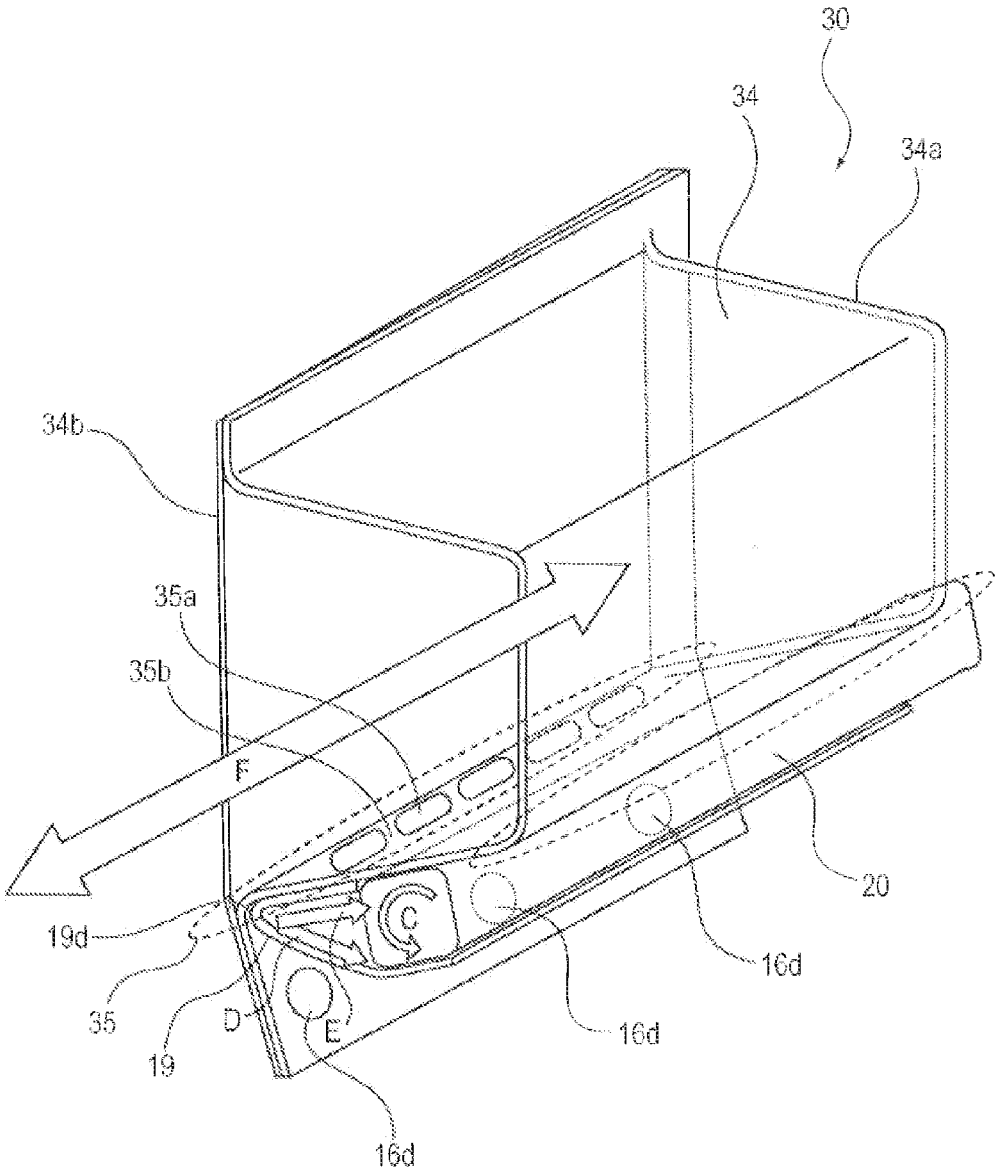

FIG. 22 is a perspective illustration showing a structure of a developer accommodating unit according to the present invention in Eleventh Embodiment.

Figure 23:
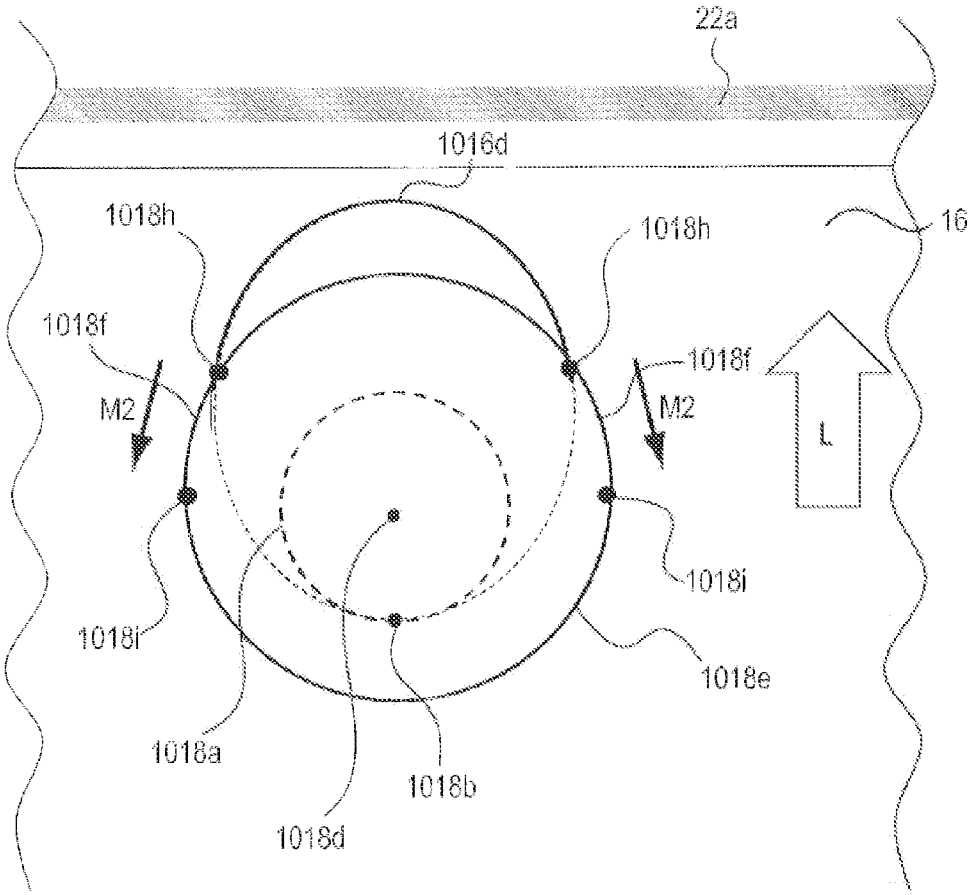

FIG. 23 is an illustration showing a state of a retaining portion in a comparison example as seen by projecting the retaining portion on a plane perpendicular to an axis of a fixing shaft portion.

Figure 24:
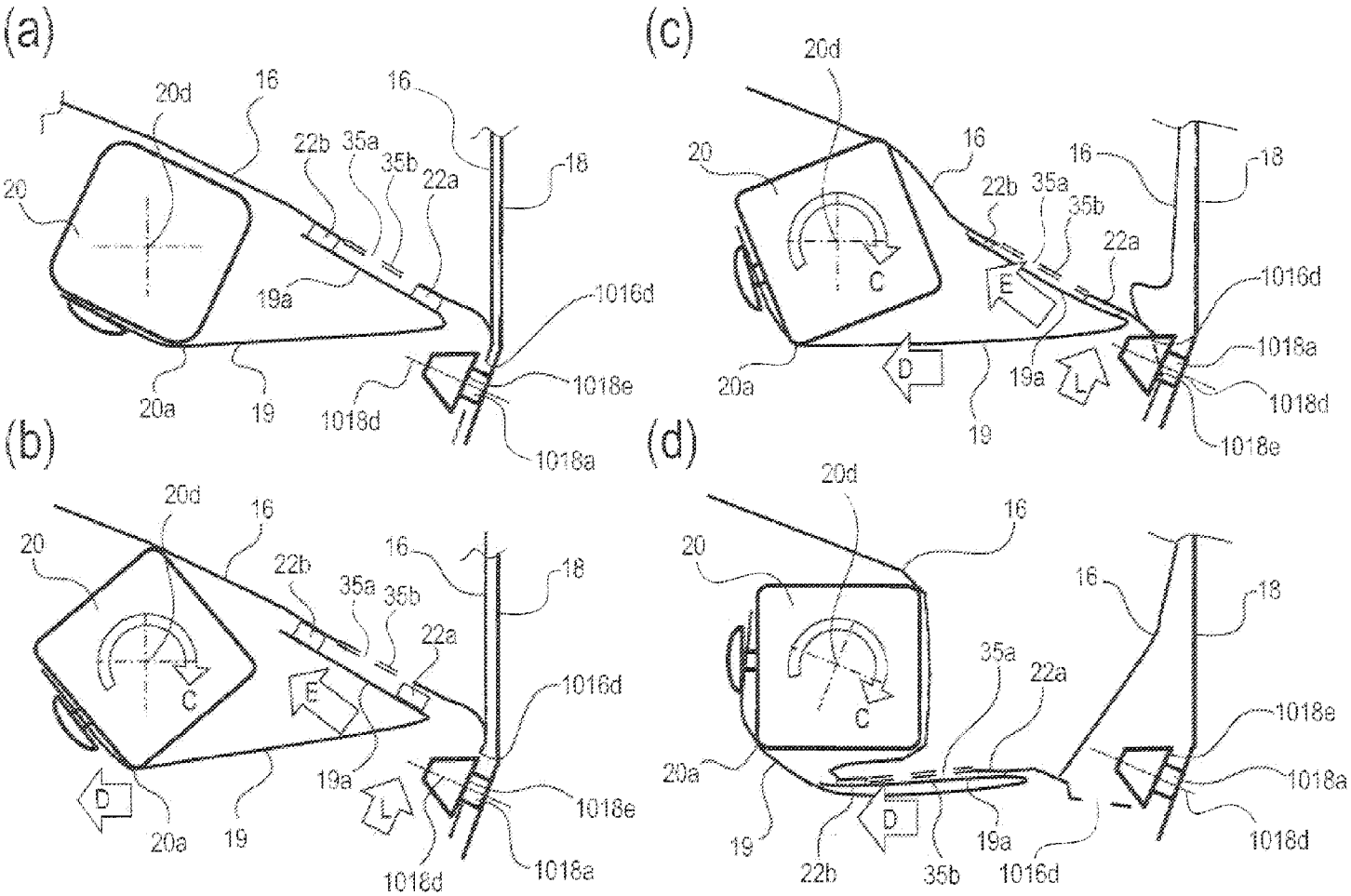

Parts (a) to (d) of FIG. 24 are sectional illustrations showing an unsealing process for illustrating that unsealing is difficult when the retaining portion in the comparison example is used.

Figure 25:
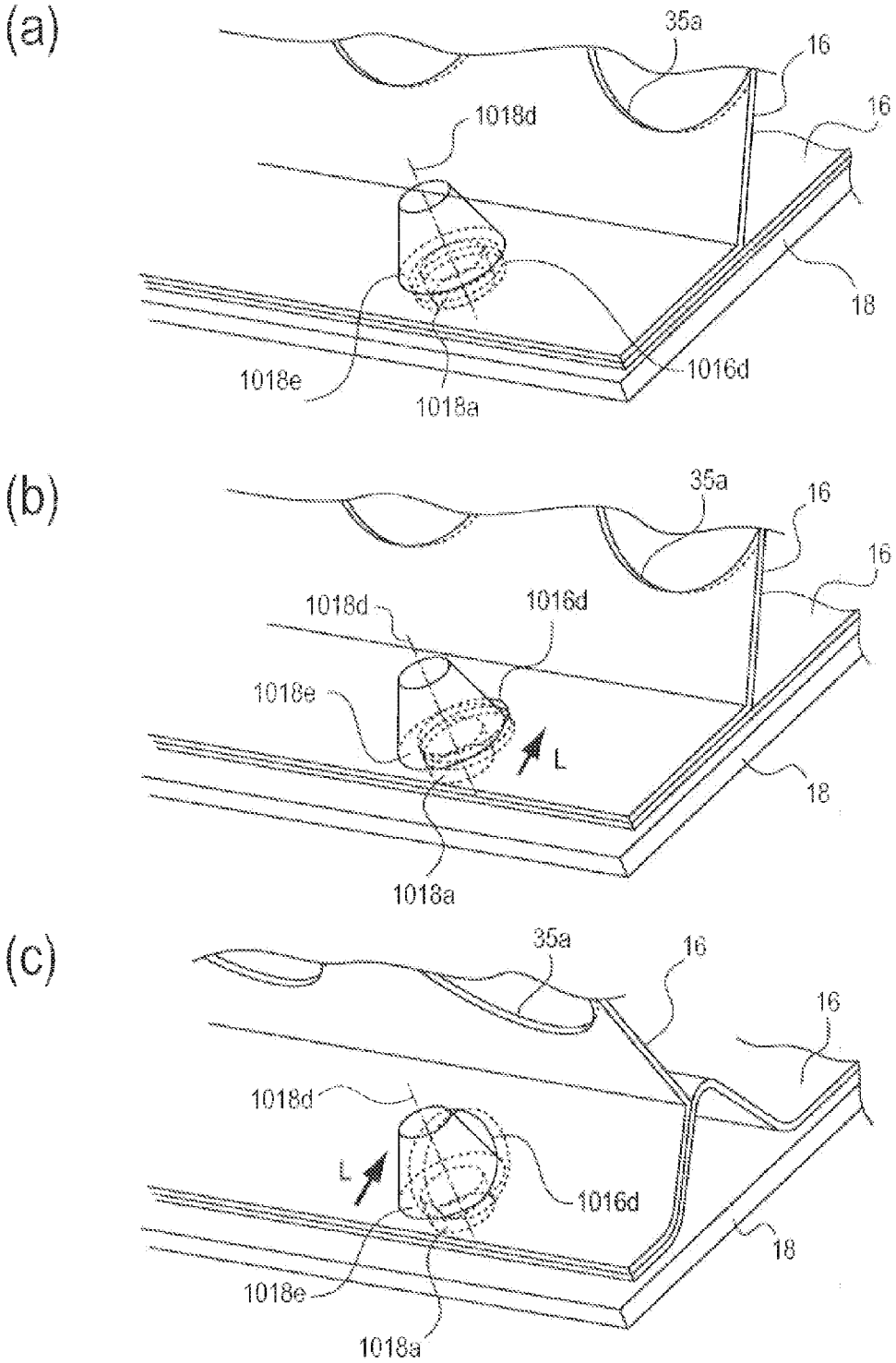

Parts (a) to (c) of FIG. 25 are perspective illustrations showing the unsealing process for illustrating that the unsealing is difficult when the retaining portion in the comparison example is used.

Figure 26:
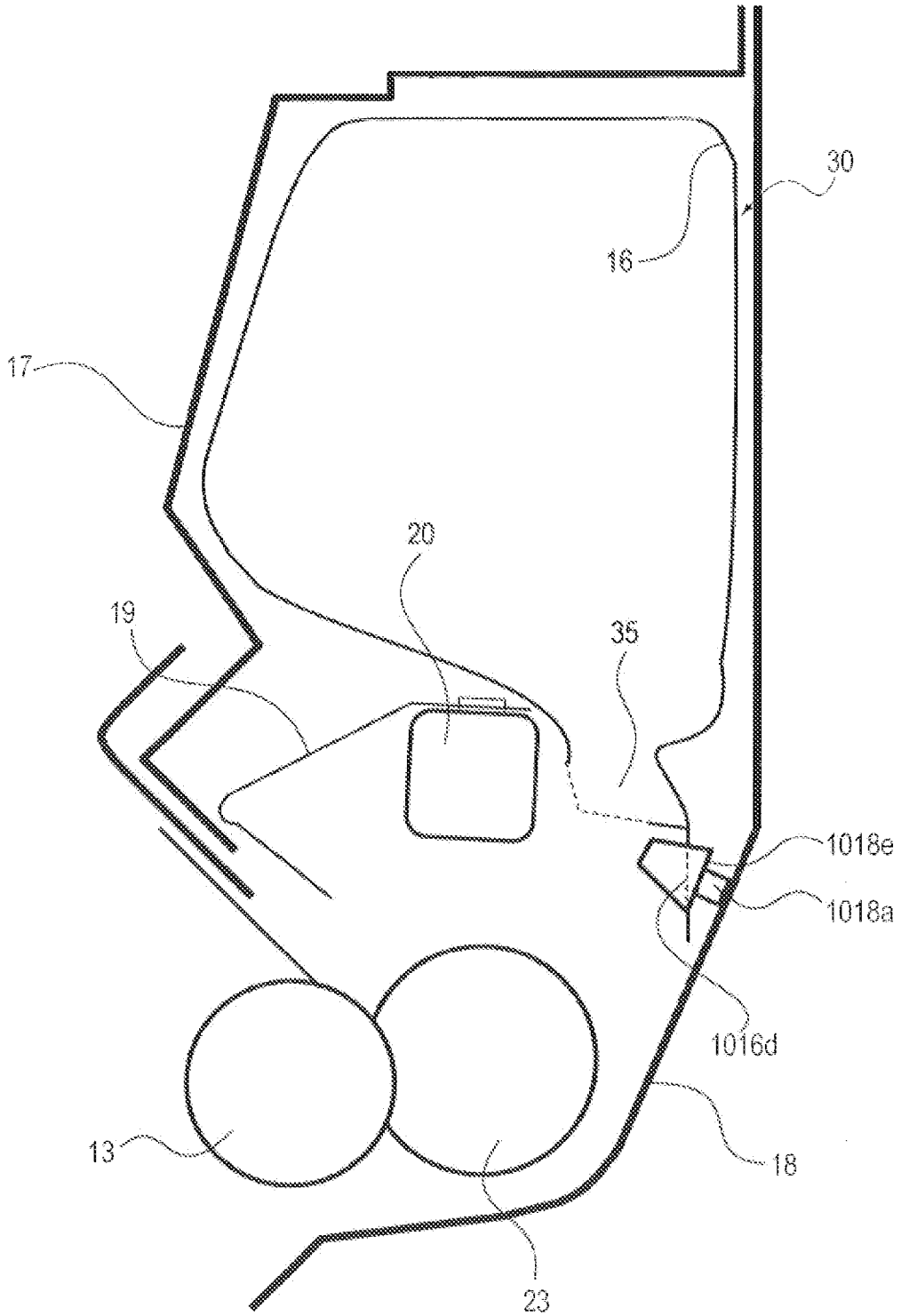

FIG. 26 is a sectional illustration showing a state in which when the retaining portion in the comparison example is used, a fastening hole is disengaged from the retaining portion to unseal a flexible container and then the flexible container is deformed, so that a developer cannot be stably supplied to a developer supplying roller.

DESCRIPTION OF THE PREFERRED EMBODIMENTS

Embodiments of a developer accommodating unit according to the present invention will be specifically described with reference to the drawings.

Embodiment 1

First, with reference to FIGS. 1 to 10, a constitution of a developer accommodating unit according to the present invention in First Embodiment will be described.

Figure 3:
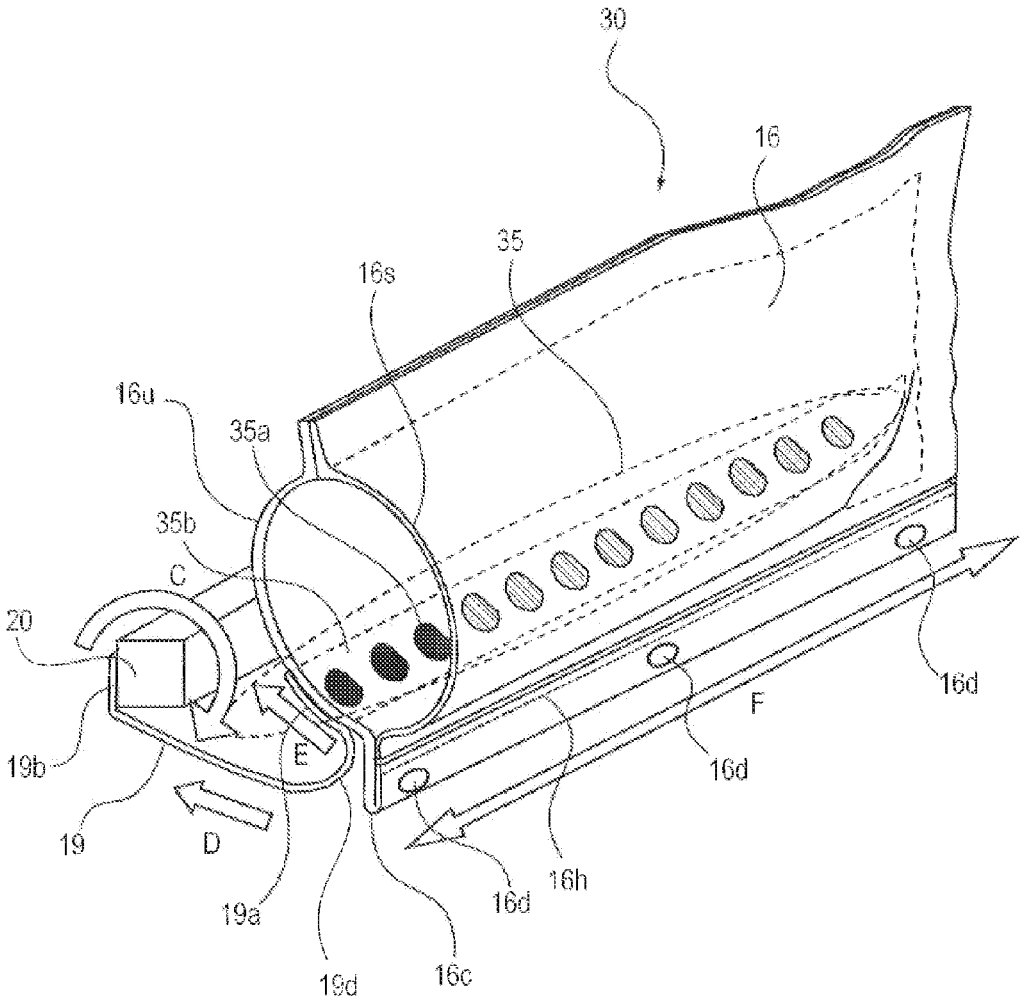
FIG. 3 is a perspective illustration showing a state in which an opening of a flexible container is unsealed (opened) by an unsealing member in the developer accommodating unit.

As shown in FIG. 3, a developer accommodating container 30 includes a developing bag 16 as a flexible container which accommodates at least a developer (toner, carrier and the like) and which is provided with an opening 35*a* for permitting discharge of the developer. The developer accommodating container 30 further includes a sealing portion 19*a* for sealing the opening 35*a*, provided in the developing bag 16, for discharging the developer, and includes a sealing member 19, mounted on the developing bag 16, capable of exposing the opening 35*a* by being moved.

Figure 1:
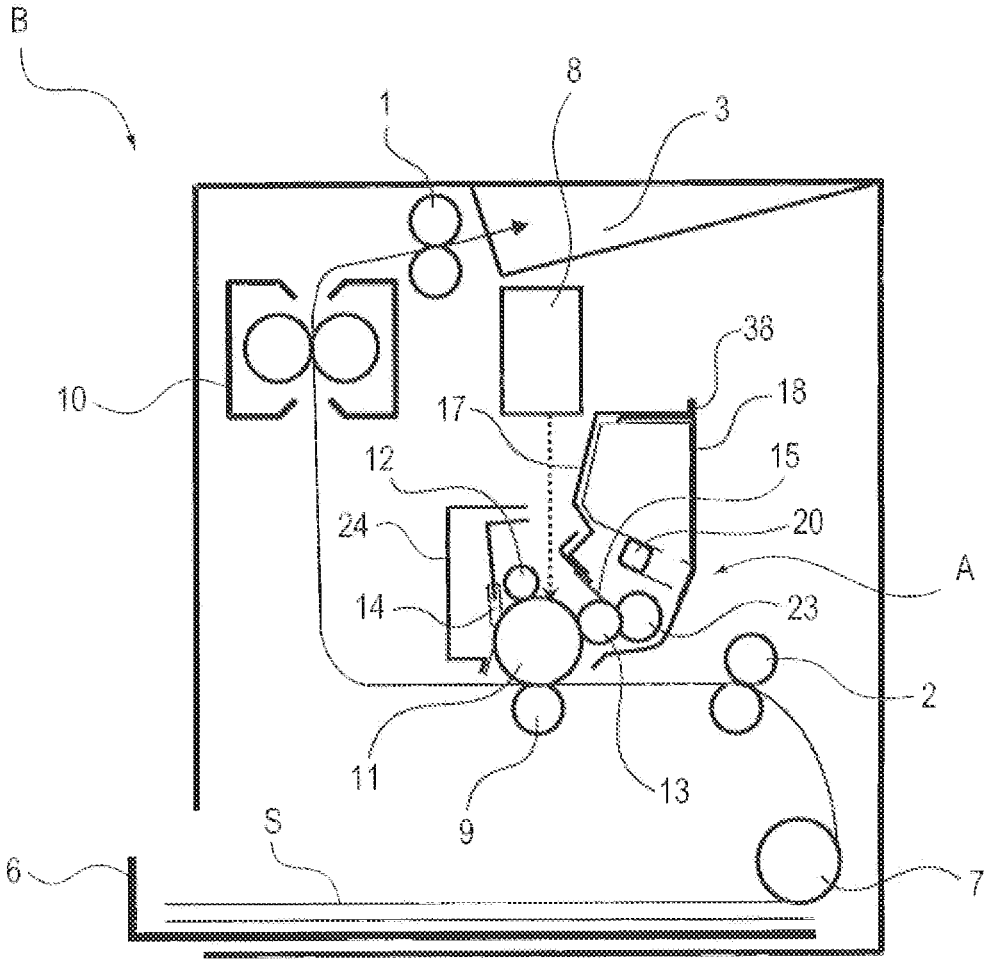
FIG. 1 is a sectional illustration showing a structure of an image forming apparatus including a developer accommodating unit according to the present invention.
Figure 2:
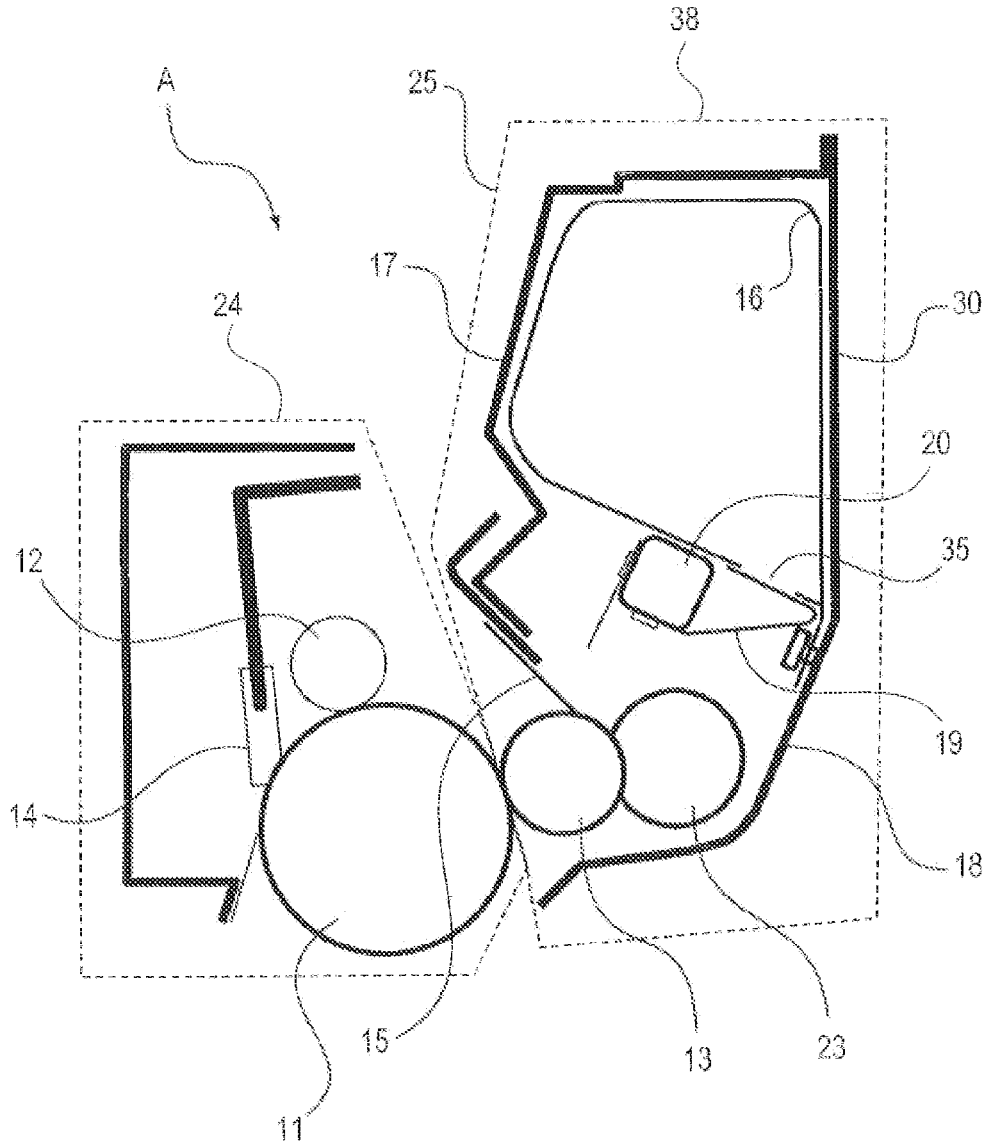
FIG. 2 is a sectional illustration showing a structure of a process cartridge including the developer accommodating unit.

FIG. 1 is a sectional illustration showing a structure of an image forming apparatus B to which a developer accommodating unit 25 according to the present invention is applicable. FIG. 2 is a sectional illustration showing a structure of a process cartridge A including the developer accommodating unit 25 according to the present invention.

<Process Cartridge>

As shown in FIGS. 1 and 2, the process cartridge A includes a photosensitive drum 11 as an image bearing member on which surface an electrostatic latent image depending on image information is to be formed, and includes an image forming process means actable on the photosensitive drum 11. Here, as the image forming process means, e.g., a charging roller 12 as a charging means for electrically charging the surface of the photosensitive drum 11 is used.

Further, the process cartridge A includes a developing device 38 as a developing means for forming a toner image on the surface of the photosensitive drum 11 by supplying a toner to the electrostatic latent image formed by subjecting the surface of the photosensitive drum 11, electrically charged uniformly by the charging roller 11, to exposure to light depending on the image information by an exposure device 8 as an exposure means. The process cartridge A further includes a cleaner unit 24 including a cleaning blade 14 as a cleaning means for removing the developer remaining on the surface of the photosensitive drum 11.

The process cartridge A in this embodiment includes, as shown in FIG. 2, at a periphery of the photosensitive drum 11, the charging roller 12 and the cleaning unit 24 including the cleaning blade 14 having elasticity. Further, the process cartridge A includes the developing device 38 including a first frame 17 and a second frame 18. By the first frame 17 and the second frame 18, an unsealing member 20 for moving a sealing member 19 and the developer accommodating container 30 are accommodated.

The process cartridge A integrally includes the cleaner unit 24 and the developing device 38 and is, as shown in FIG. 1, constituted so as to be detachably mountable to a main assembly of the image forming apparatus B. The developing device 38 includes a developing roller 13 as a developer carrying member for supplying the developer to the surface of the photosensitive drum 11. The developing device 38 further includes a developing blade 15 for regulating a layer thickness of the developer on the surface of the developing roller 13, a developer supplying roller 23 for supplying the developer to the developing roller 13, and the developer accommodating container 30 for accommodating the developer. The developing roller 13 and the developing blade 15 are supported by the first frame 17.

<Image Forming Apparatus>

The process cartridge A shown in FIG. 2 is mounted in the main assembly of the image forming apparatus B and then is used for image formation. In an image forming operation, a sheet S is fed, by a feeding roller 7, from a sheet cassette 6 mounted at a lower portion of the image forming apparatus B shown in FIG. 1. In synchronism with a feeding operation of the sheet S, the surface of the photosensitive drum 11 uniformly charged by the charging roller 12 is subjected to selective exposure to light by the exposure device 8, so that the electrostatic latent image is formed.

The developer accommodated in the developer accommodating container 30 is supplied to the developing roller 13 by the developer supplying roller 23 in a sponge-like shape, so that the developer is carried in a thin layer on the surface of the developing roller 13 by the developing blade 15.

By applying a developing bias voltage to the developing roller 13, the toner is supplied depending on the electrostatic latent image formed on the surface of the photosensitive drum 11, so that the latent image is developed into a toner image. On the other hand, the sheet S fed by the feeding roller 7 is conveyed, by a registration roller 2, to a transfer nip formed between the photosensitive drum 11 and a transfer roller 9 in synchronism with rotation of the photosensitive drum 11.

Then, by applying a transfer bias voltage to the transfer roller 9, the toner image formed on the surface of the photosensitive drum 11 is transferred onto the sheet S conveyed to the transfer nip. The sheet S on which the toner image is transferred is conveyed into a fixing device 10, in which the toner image is heated and pressed to be fixed on the sheet S. The sheet S on which the toner image is fixed is discharged, by a discharging roller 1 onto a discharge portion 3 located at an upper portion of the image forming apparatus B.

<Developer Accommodating Unit>

Next, with reference to FIGS. 3 to 5, a constitution of the developer accommodating unit 25 will be described. FIG. 3 is a perspective illustration showing a part of the developing bag 16 of the developer accommodating container 30 in cross section. Part (a) of FIG. 4 is a sectional illustration of the developing device 38, and (b) of FIG. 4 is a partly enlarged view of (a) of FIG. 4. The cross section shown in (a) of FIG. 4 is cut along a plane perpendicular to a rotation shaft 20*d* of the unsealing member 20. FIG. 5 is a perspective illustration showing a state before the developing bag 16 is unsealed.

As shown in FIG. 4, the developer accommodating unit 25 for accommodating the developer is constituted by including the developer accommodating container 30, the developing roller 13, the developing blade 15, the developer supplying roller 23 and the first and second frames 17 and 18 which support these members. The first and second frames 17 and 18 constitute in combination a frame for accommodating the developer accommodating container 30.

In this embodiment, the developer accommodating unit 25 is equivalent to the developing device 38. This is because the developer accommodating unit 25 in this embodiment is constituted by including the developing roller 13, the developing blade 15 and the developer supplying roller 23. However, a constitution in which a frame separated from the first and second frames 17 and 18 of the developer accommodating unit 25 is used to support the developing roller 13, the developing blade 15 and the developer supplying roller 23 and thus is separated from the developer accommodating unit 25 may also be employed. In this case, the developing device 38 is constituted by including the developer accommodating unit 25, the developing roller 13, the developing blade 15 and the developer supplying roller 23.

<Unsealing Member and Developer Accommodating Container>

With reference to FIGS. 3 and 4, constitutions of the unsealing member 20 and the developer accommodating container 30 will be described.

The unsealing member 20 is mounted on the developing bag 16 and in a state in which the opening 35*a* is sealed includes an engaging portion 20*b* engaged with an engaged portion 19*b* of the sealing member 19 capable of exposing the opening 35*a* by being moved. Further, the engaging portion 19*b* of the sealing member 19 and the engaging portion 20*b* of the unsealing member 20 are engaged with each other, so that the unsealing member 20 and the developing bag 16 provided in the developer accommodating container 30 are connected.

<Structure of Developing Bag>

As shown in FIGS. 3 and 4, the developing bag 16 is constituted by a bag-like elastic member deformable in shape and accommodates the developer therein. The developing bag 16 includes a discharge portion 35 for permitting discharge of the accommodated developer, and the discharge portion 35 is provided with a plurality of openings 35*a* through which the developer is to be discharged.

As shown in FIG. 5, a periphery of the discharge portion 35 of the developing bag 16 is continuously surrounded by the unsealing member 19 and is bonded unsealably by a bonding portion 22. As a result, the developer accommodated in the developing bag 16 is confined.

As shown in FIG. 3, the developing bag 16 is constituted by bonding a sheet 16*u* including the discharge portion 35 and a sheet 16*s* with no discharge portion 35 to each other. Further, the developing bag 16 includes a fastening hole 16*d* into which a fixing shaft portion 18*a* provided on the second frame 18 is to be inserted and fixed.

<Bonding Portion of Developing Bag>

As shown in FIG. 5, the bonding portion 22 for unsealably bonding the periphery of the discharge portion 35 of the developing bag 16 includes a first bonding portion 22*a* and a second bonding portion 22*b* which are provided along an arrow F direction of FIG. 5 which is a longitudinal direction of the bonding portion 22. The bonding portion 22 further includes a third bonding portion 22*c* and a fourth bonding portion 22*d* which are provided along an arrow E direction of FIG. 5 which is a widthwise direction of the bonding portion 22. The openings 35*a* are surrounded by the first to fourth bonding portions 22*a* to 22*d* in a rectangular shape to seal the discharge portion 35.

The sealing member 19 is wound about the unsealing member 20 rotationally driven in an arrow C direction of FIG. 3, thus being pulled in an arrow D direction of FIGS. 3 and 5. Then, of the first bonding portion 22*a* and the second bonding portion 22*b* which are welded with respect to the arrow F direction (left-right direction) of FIG. 5, the first bonding portion 22*a* is first unsealed. Thereafter, the second bonding portion 22*b* is unsealed.

In this embodiment, in the case where the developing bag 16 is viewed along the surface of the sealing member 19 shown in FIG. 3, the first bonding portion 22*a* is located in a side close to the engaged portion 19*b* locked by the unsealing member 20 (or close to a fold-back portion 19*d*). Further, the second bonding portion 22*b* opposes the first bonding portion 22*a* via the openings 35*a* as shown in FIG. 5.

In this embodiment, an unsealing direction of the sealing member 19 is the arrow E direction shown in FIGS. 3 and 5. In this embodiment, the unsealing direction of the sealing member 19 is defined as follows. That is, in the case where the unsealing is effected by moving the sealing member 19, of the first bonding portion 22*a* and the second bonding portion 22*b* which oppose to each other via the openings 35*a*, the first bonding portion 22*a* is first peeled and unsealed. In this way, a direction directed from the first bonding portion 22*a*, which is first unsealed, toward the second bonding portion 22*b* is defined as the unsealing direction which is the arrow E direction shown in FIG. 5.

<Opening of Developing Bag>

Next, with reference to FIG. 5, arrangement of the openings 35*a* provided at the discharge portion 35 of the sealing member 19 will be described. The sealing member 19 seals the openings 35*a*. The sealing member 19 is pulled by being wound about the rotationally driven unsealing member 20 to be moved in the arrow D direction, thus exposing the openings 35*a*.

By the movement of the sealing member 19 in the arrow D direction of FIG. 5, the exposure of the openings 35*a* is advanced in the unsealing direction which is the arrow E direction of FIG. 5. The plurality of openings 35*a* which are through holes are formed with predetermined pitches with respect to the arrow F direction of FIG. 5 perpendicular to the unsealing direction (arrow E direction) of FIG. 5. The respective adjacent openings 35*a* are spaced by a plurality of connecting portions 35*b*, so that a predetermined tensile strength of the developing bag 16 is ensured.

The sealing member 19 has a constitution in which the sealing member 19 is wound up by rotating the unsealing member 20, and the arrow F direction along which the plurality of openings 35*a* are arranged in a rectilinear shape is parallel to an axial direction of the rotation shaft 20*d* of the unsealing member 20. Further, also a rotational axis direction of the developing roller 13 shown in FIG. 4 is parallel to the arrow F direction of FIG. 3. The rotational axis direction of the developing roller 13 and the arrow F direction along which the plurality of openings 35*a* are arranged in the rectilinear line shape are made parallel to each other, so that when the developer in the developing bag 16 is discharged through the openings 35*a*, the developer is supplied uniformly over the rotational axis direction (longitudinal direction) of the developing roller 13.

<Sealing Member>

As shown in FIGS. 3 and 4, the sealing member 19 includes the sealing portion 19*a* for sealing (covering) the developing bag 16 to confine the developer in the developing bag 16 before use of the process cartridge A and includes the engaged portion 19*b* engaged with the unsealing member 20, and is formed in a sheet shape.

The engaged portion 19*b* is engaged with the unsealing member 20 for exposing the openings 35*a* by being rotated to move the sealing member 19. The unsealing member 20 in this embodiment is constituted by the rotation shaft 20*d* rotatably provided in the second frame 18.

Further, the sealing member 19 includes the fold-back portion 19*d* folded back at a portion between the sealing portion 19*a* and the engaged portion 19*b*. The fold-back portion 19*d* may be provided with a fold or with no fold. A fold-back angle Q of the fold-back portion 19*d* of the sealing member 19 shown in (b) of FIG. 4 may preferably be 90 degrees or less. A material for the sealing member 19 is constituted by a laminate material having a sealant layer which is easily unsealable, and its base material is polyethylene terephthalate (PET), polyethylene, polypropylene or the like. A thickness of the base material may appropriately be selected from a range of 0.03 mm to 0.15 mm.

<Unsealing Member>

The unsealing member 20 applies a force to the sealing member 19 to move the sealing member 19, so that the sealing portion 19*a* is peeled off from the openings 35*a* of the developing bag 16 to unseal the openings 35*a*. The unsealing member 20 includes an unshown supporting portion which has a shaft shape and which is rotatably supported by the second frame 18 at its end portions, and includes the engaging portion 20*b* for fixing the engaged portion 19*b* of the sealing member 19.

As shown in (b) of FIG. 9, the unsealing member 20 is provided, with respect to a direction of an axis 18*d* of the fixing shaft portion 18*a* provided to stand at an inner surface of the second frame 18, toward an end of the fixing shaft portion 18*a* remote from the second frame 18. Further, the unsealing member 20 is disposed at a position in a side where a retaining portion 18*e* for preventing the fixing shaft portion 18*a* from being disengaged from the fastening hole 16*d* of the developing bag 16 (in a side of an arrow J direction of (b) of FIG. 4).

<Fixing Shaft Portion and Retaining Portion>

Next, with reference to FIGS. 3, 4 and 6 to 10, constitutions of the fixing shaft portion 18*a* provided to stand at the inner surface of the second frame 18 and the retaining portion 18*e*, which is provided at the end of the fixing shaft portion 18*a*, for preventing the fixing shaft portion 18*a* from being disengaged from the fastening hole 16*d* of the developing bag 16 will be described.

FIG. 6 is an illustration as seen by projecting the retaining portion 18*e* on a plane perpendicular to the axis 18*d* of the fixing shaft portion 18*a*. Parts (a) to (c) of FIG. 7 are perspective views for illustrating a state in which an edge portion of the fastening hole 16*d* rides over the retaining portion 18*e* by its elastic deformation to lock the fixing shaft portion 18*a* inserted into the fastening hole 16*d*. Parts (a) to (f) of FIG. 8 are sectional views for illustrating a process of unsealing the openings 35*a* of the developing bag 16 by the unsealing member 20.

Part (a) of FIG. 9 is a sectional illustration showing an example of a (spacing) distance K between the retaining portion 18*e* and the first bonding portion 22*a* on a movement path, and (b) of FIG. 9 is a sectional illustration showing an example of the distance K between the retaining portion 18*e* and the first bonding portion 22*a* on the movement path in the case where a shape of the developing bag 16 having flexibility is deformed.

FIG. 10 is a schematic view of the retaining portion 18*e* as seen by projecting the retaining portion 18*e* on the plane perpendicular to the axis 18*d* of the fixing shaft portion 18*a*, and is an illustration showing a state in which an outer end portion 18*i* of a rectilinear locking edge line 18*f* outside an edge portion of the fastening hole 16*d* has a distance closer to the first bonding portion 22*a* than a locking portion 18*h* where the edge portion of the fastening hole 16*d* is locked.

As shown in FIG. 4, the developing bag 16 is provided with the fastening hole 16*d* for locking and fixing the fixing shaft portion 18*a* provided to stand at the inner surface of the second frame 18. An edge portion of the fastening hole 16*d* rides over the retaining portion 18*e* by its elastic deformation to lock the fixing shaft portion 18*a* inserted into the fastening hole 16*d*.

When the retaining portion 18*e* is, as shown in FIGS. 6 and 7, projected on a plane perpendicular to the axis 18*d* of the fixing shaft portion 18*a*, the retaining portion 18*e* has a shape such that a trapezoidal recessed portion is formed as a part of a rectangular shape having an outer configuration larger than a diameter of the edge portion of the fastening hole 16*d* of the developing bag 16. Further, the locking edge line 18*f* for being locked by the edge portion of the fastening hole 16*d* is formed in a rectilinear shape.

Next, with reference to FIG. 7, a method of locking and fixing the fixing shaft portion 18*a*, provided to stand at the inner surface of the second frame 18, by being inserted into the fastening hole 16*d* provided in the developing bag 16, will be described. The fastening hole 16*d* provided in the developing bag 16 is, as shown in FIG. 3, constituted by making a through hole in a bonding portion 16*c* between the sheet 16*u* and the sheet 16*s* which form the developing bag 16. The edge portion of the fastening hole 16*d* is also an elastically deformable member similarly as the developing bag 16.

First, as shown in (a) of FIG. 7, the fastening hole 16*d* of the developing bag 16 is moved from an end portion side (upper side of the figure) in an arrow Y direction in the figure to insert the fixing shaft portion 18*a* into the fastening hole 16*d*. Next, as shown in (b) of FIG. 7, the edge portion of the fastening hole 16*d* rides over the retaining portion 18*e* by being expanded based on its elastic deformation, so that the fixing shaft portion 18*a* is inserted into the fastening hole 16*d* as shown in (c) of FIG. 7. After the edge portion of the fastening hole 16*d* rides over the retaining portion 18*e* by its elastic deformation, as shown in (c) of FIG. 7, the edge portion of the fastening hole 16*d* is contracted, so that its shape is restored to the shape, shown in (a) of FIG. 7, before the edge portion of the fastening hole 16*d* rides over the retaining portion 18*e*. As a result, the fixing shaft portion 18*a* is locked and fixed by the fastening hole 16*d* at the retaining portion 18*e* in a state in which the fixing shaft portion 18*a* is inserted into the fastening hole 16*d*.

In this embodiment, when the developing bag 16 is fixed to the second frame 18, a special tool for thermal caulking or ultrasonic caulking is not required, and an additional member such as a solvent, an adhesive or double-side tape is also not required. Thus, the developing bag 16 can be fixed to the second frame 18.

The fastening hole 16*d* receives a force when the sealing member 19 is unsealed (peeled) from the developing bag 16. The fastening hole 16*d* is, as shown in FIG. 3, provided at a plurality of positions at predetermined pitches with respect to a direction parallel to the arrow F direction in which the plurality of openings 35*a* are disposed. These fastening holes 16*d* are provided in the neighborhood of the openings 35*a*. The fixing shaft portion 18*a* provided to stand at the inner surface of the second frame 18 is inserted into the fastening hole 16*d* to be engaged in the fastening hole 16*d*, and thus the fixing shaft portion 18*a* is locked by the fastening hole 16*d* at the retaining portion 18*e*, so that movement of the developing bag 16 in a direction perpendicular to the axis 18*d* of the fixing shaft portion 18*a* is suppressed.

Further, at the end of the fixing shaft portion 18*a*, the retaining portion 18*e* having an outer peripheral diameter larger than the (inner peripheral) diameter of the fastening hole 16*d* is provided. By the retaining portion 18*e* and the inner surface of the second frame 18, the edge portion of the fastening hole 16*d* is sandwiched. As a result, the movement of the developing bag 16 in the direction of the axis 18*d* of the fixing shaft portion 18*a* is suppressed.

As shown in FIG. 4, when the unsealing member 20 is rotated about the rotation shaft 20*d* in the arrow C direction to wind the sealing member 19 around the outer peripheral surface of the unsealing member 20 and thus the sealing member 19 is pulled in the arrow D direction of FIG. 4, the sealing portion 19*a* of the sealing member 19 is peeled from the developing bag 16. At this time, when the developing bag 16 is pulled in the arrow D direction via the sealing member 19, as shown in (c) and (d) of FIG. 9, a force for pulling, in the arrow D direction of (c) of FIG. 8, the fastening hole 16*d* of the developing bag 16 into which the fixing shaft portion 18*a* is inserted is exerted on the fastening hole 16*d*. Then, the developing bag 16 is pulled in the arrow D direction of (c) of FIG. 8 so that its edge portion locked by the retaining portion 18*e* provided at the end of the fixing shaft portion 18*a* is moved toward a force application point portion 20*a* where the unsealing member 20 winds the sealing member 19.

When the developing bag 16 is pulled in the arrow D direction of (c) of FIG. 8, the edge portion of the fastening hole 16*d* is as shown in FIG. 6, pulled in an arrow L direction (predetermined direction) perpendicular to the arrow F direction, so that the edge portion of the fastening hole 16*d* abuts against a rear end portion 18*b*, with respect to the arrow L direction, of the fixing shaft portion 18*a* having an elliptical shape in cross section and then is moved until the edge portion of the fastening hole 16*d* abuts against the retaining portion 18*e*.

As shown in FIG. 6, the edge portion of the fastening hole 16*d* in the leading end portion side of the developing bag 16 with respect to the arrow L direction abuts against the locking edge line 18*f* of the retaining portion 18*e* disposed in the leading end portion side with respect to the arrow L direction, thus being locked.

In this embodiment, as shown in FIG. 6, when the retaining portion 18*e* is projected on a plane perpendicular to the axis 18*d* of the fixing shaft portion 18*a*, the locking edge line 18*f* of the retaining portion 18*e* for locking the edge portion of the fastening hole 16*d* during the unsealing of the sealing member 19 is considered. The outer end portion 18*i*, of the locking edge line 18*f*, outside the edge portion of the fastening hole 16*d* is disposed downstream of the locking portion 18*h*, where the edge portion of the fastening hole 16*d* is locked, with respect to the arrow L direction (predetermined direction) of FIG. 6 which is a pulling direction of the edge portion of the fastening hole 16*d*.

In such a shape of the retaining portion 18*e*, the outer end portion 18*i*, outside the edge portion of the fastening hole 16*d*, on the locking edge line 18*f* has a shorter distance to the first bonding portion 22*a* than the locking portion 18*h* where the edge portion of the fastening hole 16*d* is locked.

As shown in FIG. 10, the case where the fastening hole 16*d* has a shape such that the edge portion of the fastening hole 16*d* has play with respect to the fixing shaft portion 18*a* in the arrow F direction of FIG. 10 is considered. In that case, the outer end portion 18*i* is disposed downstream (in the upper side in FIG. 10), with respect to the arrow L direction of FIG. 10 as the pulling direction of the edge portion of the fastening hole 16*d*, of the locking portion 18*h*, where the edge portion of the fastening hole 16*d* is locked, on the locking edge line 18*f* of the retaining portion 18*e*. The outer end portion 18*i* of the locking edge line 18*f* is disposed outside the edge portion of the fastening hole 16*d*. Then, the shape such that the distance from the outer end portion 18*i* to the first bonding portion 22*a* is smaller than the distance from the locking portion 18*h* to the first bonding portion 22*a* will be described.

There is the case where the edge portion of the fastening hole has play with respect to the fixing shaft portion 18*a* in the arrow F direction of FIG. 10. In that case, the distance to the first bonding portion 22*a* is shorter at a position in which the locking portion 18*h*, where the edge portion of the fastening hole 16*d* is locked, on the locking edge line 18*f* of the retaining portion 18*e* is capable of being remotest to the fixing shaft portion 18*a* than at a position in which the locking portion 18*h* is capable of being closest to the fixing shaft portion 18*a*. The outer end portion 18*i* is disposed outside of the edge portion of the fastening hole 16*d* on the locking edge line 18*f*.

Further, the shorter distance K from the first bonding portion 22*a* refers to, as shown in (a) and (b) of FIG. 9, the distance K from the position on the locking edge line 18*f* to the first bonding portion 22*a* on a path along the surface of the developing bag 16.

There is the case where the shape of the flexible developing bag 16 is deformed as shown in (b) of FIG. 9. Also in that case, similarly as in the case of (a) of FIG. 9, the distance K to the first bonding portion 22*a* is shorter at the outer end portion 18*i* outside the edge portion of the fastening hole 16*d* on the locking edge line 18*f* of the retaining portion 18*e* than at the locking portion 18*h* where the edge portion of the fastening hole 16*d* on the locking edge line 18*f*.

In this way, the fixing shaft portion 18*a* provided to stand at the inner surface of the second frame 18 and the retaining portion 18*e* provided at the end of the fixing shaft portion 18*a* support the developing bag 16 against a pulling force of the sealing member 19 when the sealing member 19 for the developing bag 16 is pulled to unseal the openings 35*a*.

<Unsealing Operation of Developing Bag>

Next, with reference to FIGS. 4, 6 and 8, an unsealing operation of the sealing portion 19*a* from the developing bag 16 will be described.

The pulling force for pulling the sealing member 19 in the arrow D direction of (a) of FIG. 4 is applied to the force application point portion 20*a* where a corner portion of the unsealing member 20, having the rectangular shape in cross section, rotated about the rotation shaft in the arrow C direction of (a) of FIG. 4 in order to unseal the sealing portion 19*a* for the developing bag 16 contacts the sealing member 19. The developing device 38 includes the fixing shaft portion 18*a*, provided to stand at the inner surface of the second frame 18, locked by being inserted into the fastening hole 16*d* of the developing bag 16 pulled by the sealing member 19 wound by the unsealing member 20, and includes the retaining portion 18*e* provided at the end of the fixing shaft portion 18*a*.

The force application point portion 20*a* where the corner portion of the unsealing member 20 contacts the sealing member 19 is, of portions where the sealing member 19 and the corner portion of the unsealing member 20 contact each other when the sealing portion 19*a* for the developing bag 16 is unsealed, a portion closest to the first bonding portion 22*a* on the sealing member 19.

First, as shown in (a) of FIG. 4, a rotational driving force is transmitted to the unsealing member 20 by an unshown driving means provided in the main assembly of the image forming apparatus B, so that the unsealing member 20 is rotated about the rotation shaft 20*d* in the arrow C direction in (a) of FIG. 4. Then, the rotation of the unsealing member 20 is advanced, so that the sealing member 19 including the engaged portion 19*b* locked by the engaging portion 20*b* of the unsealing member 20 is pulled in the arrow D direction of (a) of FIG. 4 to start the unsealing at the first bonding portion 22*a*. A state immediately before the unsealing at the first bonding portion 22*a* is shown in (a) and (b) of FIG. 8.

As shown in (c) and (d) of FIG. 8, with the rotation of the unsealing member 20, the sealing member 19 is pulled in the arrow D direction of (c) of FIG. 8. The sealing member 19 fixed on the unsealing member 20 at the engaged portion 19*b* is pulled in the arrow D direction of (c) of FIG. 8 by the pulling force acting on the force application point portion 20*a* as the contact portion between the corner portion of the unsealing member 20 and the sealing member 19. When the sealing member 19 is pulled in the arrow D direction of (c) of FIG. 8, the developing bag 16 is pulled in the arrow D direction of (c) of FIG. 8 via the first bonding portion 22*a*. At this time, the edge portion of the fastening hole 16*d* of the developing bag 16 is pulled in the arrow L direction of (d) of FIG. 8.

In this case, the edge portion of the fastening hole 16*d* is contacted to and locked by a rear end portion 18*b* of the fixing shaft portion 18*a* and the locking edge line 18*f* of the retaining portion 18*e*, and its movement is suppressed, so that the developing bag 16 is pulled toward the force application point portion 20*a*. Then, in cross section distance the rotation shaft 20*d* of the unsealing member 20 shown in (c) of FIG. 8, the first bonding portion 22*a* moves so as to approach a rectilinear line connecting the force application point portion 20*a* with the locking portion 18*h* on the locking edge line 18*f*. Further, the sealing member 19 is folded back at the fold-back portion 19*d* between the first bonding portion 22*a* and the engaged portion 19*b*. For this reason, the pulling force acts on the first bonding portion 22*a* so as to perform inclination peeling of the first bonding portion 22*a* in the arrow D direction of (c) of FIG. 8, so that the first bonding portion 22*a* is peeled to start the unsealing of the openings 35*a*.

A state in which after the peeling of the first bonding portion 22*a* is performed to unseal the sealing member 19 and thus the openings 35*a* are exposed, peeling of the second bonding portion 22*b* is to be started as shown in (e) and (f) of FIG. 8. Also at this time, similarly as in the case of the peeling of the first bonding portion 22*a*, the sealing member 19 is pulled toward the force application point portion 20*a*, so that the edge portion of the developing bag 16 is continuously locked by the rear end portion 18*b* of the fixing shaft portion 18*a* and the locking edge line 18*f* of the retaining portion 18*e* and thus the movement of the developing bag 16 is suppressed.

Then, in cross section perpendicular to the rotation shaft 20*d* of the unsealing member 20 shown in (e) of FIG. 8, the second bonding portion 22*b* moves so as to approach the rectilinear line connecting the force application point portion 20*a* with the locking portion 18*h* on the locking edge line 20*f*. Then, the pulling force acts on the second bonding portion 22*b* so as to perform the inclination peeling of the second bonding portion 22*b* in the arrow D direction of (e) of FIG. 8, so that the second bonding portion 22*b* is peeled and then the sealing member 19 is disengaged from the developing bag 16 and is wound around the unsealing member 20. Thus, the unsealing of the sealing member 19 is completed, so that the developer passes through the openings 35*a* to be discharged into the developer accommodating container 30, thus being supplied to the developing roller 13 via the developer supplying roller 23.

In a series of steps of the unsealing operation of the sealing portion 19*a*, as shown in FIG. 6, when the retaining portion 18*e* is projected on the plane perpendicular to the axis 18*d* of the fixing shaft portion 18*a*, the locking edge line 18*f* of the retaining portion 18*e* for locking the edge portion of the fastening hole 16*d* during the unsealing of the sealing member 19 is considered. On the locking edge line 18*f*, the distance to the first bonding portion 22*a* from the outer end portion 18*i* outside the edge portion of the fastening hole 16*d* is shorter than the distance to the first bonding portion 22*a* from the locking portion 18*h* where the edge portion of the fastening hole 16*d* is locked.

That is, the outer end portion 18*i* is closer to the first bonding portion 22*a* than the locking portion 18*h* in the downstream side with respect to the arrow L direction of FIG. 6 as the pulling direction of the edge portion of the fastening hole 16*d*. For that reason, the developing bag 16 is pulled via the sealing member 19. Then, a moving force M1 directed, along the locking edge line 18*f*, from the outer end portion 18*i* outside the edge portion of the fastening hole 16*d* on the locking edge line 18*f* toward the locking portion 18*h* where the edge portion of the fastening hole 16*d* is locked is exerted on the edge portion of the fastening hole 16*d*. By this moving force M1, the edge portion of the fastening hole 16*d* is moved (shifted) toward the locking portion 18*h*. For this reason, the edge portion of the fastening hole 16*e* is not disengaged from the retaining portion 18*e*, so that it is possible to stably realize the unsealing of the openings 35*a* of the developing bag 16.

Comparison Example

A problem in the case where a retaining portion 1018*e* having a circular truncated cone-like shape in Comparison example is used will be described below with reference to FIGS. 23 to 26. FIG. 23 is an illustration showing a state of the retaining portion 1018*e* in Comparison example as seen by projecting the retaining portion 1018*e* on a plane perpendicular to an axis 1018*d* of a fixing shaft portion 1018*a*. Parts (a) to (d) of FIG. 24 are sectional illustrations showing an unsealing process for illustrating that unsealing of the sealing portion 19*a* of the developing bag 16 is difficult when the retaining portion 1018*e* in Comparison example is used.

Parts (a) to (c) of FIG. 25 are perspective illustrations showing the unsealing process for illustrating that the unsealing of the sealing portion 19*a* of the developing bag 16 is difficult when the retaining portion 1018*e* in Comparison example is used. FIG. 26 is a sectional illustration showing a state in which when the retaining portion 1018*e* in Comparison example is used, a fastening hole 1016*d* is disengaged from the retaining portion 1018*e* to unseal the sealing portion 19*a* of the developing bag 16 and then the unsealed developing bag 16 is abnormally deformed, so that the developer cannot be stably supplied to the developer supplying roller 23.

The retaining portion 1018*e* in Comparison example is constituted in a perfect circular shape in cross section as shown in FIG. 23. Further, as shown in FIG. 23, when the retaining portion 1018*e* in Comparison example is projected on the plane perpendicular to the rotation axis 1018*d* of the fixing shaft portion 1018*a*, a locking edge line 1018*f* of the retaining portion 1018*e* for locking an edge portion of the fastening hole 1016*d* during the unsealing of the sealing member 19 is considered. On the locking edge line 1018*f*, a distance to the first bonding portion 22*a* from a locking portion 1018*h* where an edge portion of the fastening hole 1016*d* is locked is shorter (smaller) than a distance from an outer end portion 1018*i* to the first bonding portion 22*a*. The outer end portion 1018*i* is an outermost portion located outside the edge portion of the fastening hole 1016*d* on the locking edge line 1018*f*.

In this shape, as shown in (b) of FIG. 24, when the unsealing member 20 is rotated about the rotation shaft 20*d* in the arrow C direction of (b) of FIG. 24 to pull the sealing member 19 in the arrow D direction of (b) of FIG. 24, also the developing bag 16 is pulled in the arrow D direction of (b) of FIG. 24 via the first bonding portion 22*a*. Then, as shown in FIG. 23, a moving force M2 directed from the locking portion 1018*h* where the edge portion of the fastening hole 1016*d* is locked on the locking edge line 1018*f* of the retaining portion 1018*e* toward the outer end portion 1018*i* outside the edge portion of the fastening hole 1016*d* on the locking edge line 1018*f* is exerted on the edge portion of the fastening hole 1016*d*.

As shown in FIG. 23, when the moving force M2 for moving the edge portion of the fastening hole 1016*d* in the direction from the locking portion 1018*h* on the locking edge line 1018*f* of the retaining portion 1018*e* toward the outer end portion 1018*i* is exerted on the edge portion of the fastening hole 1018*d*, the fastening hole 1018*i* receives the moving force M2 in the direction in which the edge portion of the fastening hole 1016*d* is disengaged from the retaining portion 1018*e*. Then, as shown in (c) of FIG. 24 and (c) of FIG. 25, the edge portion of the fastening hole 1016*d* is disengaged from the retaining portion 1018*e* from a downstream side (upper side of (c) of FIG. 24 and (c) of FIG. 25) of the fastening hole 1016*d* with respect to the arrow L direction.

When the unsealing member 20 is further rotated about the rotation shaft 20*d* in the arrow C direction of (c) of FIG. 24, as shown in (d) of FIG. 24, the edge portion of the fastening hole 1016*d* is completely disengaged from the retaining portion

1018*e*. As a result, the unsealing of the sealing portion 19*a* for the developing bag 16 cannot be effected.

Or, as shown in (c) of FIG. 24, (c) of FIG. 25 and FIG. 26, there is the case where the unsealing of the sealing portion 19*a* for the developing bag 16 is completed in a state in which the edge portion of the fastening hole 1016*d* in the downstream side (upper side in (c) of FIG. 24 and (c) of FIG. 25) of the arrow L direction is disengaged from the retaining portion 1018*e*. In that case, as shown in FIG. 26, the developing bag 16 is placed in an abnormally deformed state. In this abnormally deformed state, a desired discharge amount of the developer through the openings 35*a* cannot be obtained. Further, a positional relationship between the developer supplying roller 23 and the openings 35*a* is different from that in a state in which the fixing shaft portion 1018*a* is completely locked and fixed by the fastening hole 1016*d*. For this reason, there arises a problem that the developer cannot be stably supplied to the developer supplying roller 23.

Second Embodiment

Next, with reference to (a) of FIG. 11, a developer accommodating unit according to the present invention in a constitution in this embodiment will be described. Incidentally, constituent elements similar to those in the above-described First Embodiment are represented by the same reference numerals or symbols and will be omitted from description.

In First Embodiment described above, the locking portion 18*h* where the edge portion of the fastening hole 16*d* is locked and the outer end portion 18*i* outside the edge portion of the fastening hole 16*d* on the locking edge line 18*f* are connected by the rectilinear line. However, the locking edge line 18*f* is not required to be the rectilinear line, but may also be a curved line as shown in (a) of FIG. 11.

Part (a) of FIG. 11 is a schematic view of a retaining portion 18*e* of a developer accommodating unit 25 in this embodiment as seen by projecting the retaining portion 18*e* on a plane perpendicular to an axis 18*d* of a fixing shaft portion 18*a*. At that time, a distance from an outer end portion 18*i* of a curved locking edge line 18*f* outside an edge portion of a fastening hole 16*d* to the first bonding portion 22*a* is smaller than a distance from a locking portion 18*h*, where the edge portion of the fastening hole 16*d* is locked, to the first bonding portion 22*a*.

When the retaining portion 18*e* in this embodiment is, as shown in (a) of FIG. 11, projected on the plane perpendicular to the axis 18*d* of the fixing shaft portion 18*a*, the retaining portion 18*e* has a shape such that a recessed portion consisting of a curved line and a rectilinear line is formed as a part of a rectangular shape having an outer configuration larger than a diameter of the edge portion of the fastening hole 16*d* of the developing bag 16. Further, the locking edge line 18*f* for being locked by the edge portion of the fastening hole 16*d* is formed in the curved shape. Further, a constitution in which the distance to the first bonding portion 22*a* from the outer end portion 18*i* outside the edge portion of the fastening hole 16*d* is shorter than the distance to the first bonding portion 22*a* from the locking portion 18*h* where the edge portion of the fastening hole 16*d* is locked was employed.

For example, as described later with reference to FIG. 19, there is the case where a distance from the locking portion 18*h* to the first bonding portion 22*a* is equal to a distance from the outer end portion 18*i*, outside the edge portion of the fastening hole 16*d* on the locking edge line 18*f*, to the first bonding portion 22*a*. The locking portion 18*h* is the portion where the edge portion of the fastening hole 16*d* is locked. Further, there is also the case where the locking portion 18*h* and the outer end portion 18*i* are disposed at the same position with respect to the arrow L direction of (a) of FIG. 11 as the pulling direction of the edge portion of the fastening hole 16*d*.

Even in that case, different from Comparison example described above with reference to FIG. 23, the moving force M2 for moving the edge portion of the fastening hole 16*d* in the direction from the locking portion 18*h*, where the edge portion of the fastening hole 16*d* is locked, toward the outer end portion 18*i* outside the edge portion of the fastening hole 16*d* on the locking edge line 18*f* is not generated. As a result, even when the developing bag 16 is pulled via the sealing member 19, the edge portion of the fastening hole 16*d* is not disengaged from the retaining portion 18*e*, so that it is possible to stably realize the unsealing of the openings 35*a* of the developing bag 16.

In this embodiment, the developing bag 16 is pulled via the sealing member 19. Then, a moving force M1 for moving the edge portion of the fastening hole 16*d* in the direction from the outer end portion 18*i* outside the edge portion of the fastening hole 16*d* on the locking edge line 18*f* toward the locking portion 18*h* where the edge portion of the fastening hole 16*d* is locked is generated. As a result, an effect similar to that in First Embodiment described above is obtained. Other constitutions are the same as those in First Embodiment, and a similar effect can be obtained.

Third Embodiment

Next, with reference to (b) of FIG. 11, a developer accommodating unit according to the present invention in a constitution in this embodiment will be described. Incidentally, constituent elements similar to those in the above-described embodiments are represented by the same reference numerals or symbols and will be omitted from description.

In the above-described First and Second Embodiments, with respect to the shape of the retaining portion 18*e* when the retaining portion 18*e* is viewed by being projected on the plane perpendicular to the rotation shaft 18*d* of the fixing shaft portion 18*a*, the whole shape excluding the portion of the locking edge line 18*f* was constituted by the rectangular shape (in cross section). In this embodiment, the whole shape excluding the portion of the locking edge line 18*f* is constituted by an elliptical shape. As a result, when the edge portion of the fastening hole 16*d* is caused to ride over the retaining portion 18*e* by being expanded based on its elastic deformation, the fixing shaft portion 18*a* is easily inserted into the fastening hole 16*d*.

Part (b) of FIG. 11 is a schematic view of a retaining portion 18*e* of a developer accommodating unit 25 in this embodiment as seen by projecting the retaining portion 18*e* on a plane perpendicular to an axis 18*d* of a fixing shaft portion 18*a*. At that time, a distance from an outer end portion 18*i* of a rectilinear locking edge line 18*f* outside an edge portion of a fastening hole 16*d* to the first bonding portion 22*a* is smaller than a distance from a locking portion 18*h*, where the edge portion of the fastening hole 18*d* is locked, to the first bonding portion 22*a*.

As shown in (b) of FIG. 11, the shape of the retaining portion 18*e* excluding the rectilinear locking edge line 18*f* is not required to be the rectilinear shape as in First Embodiment shown in FIG. 6 and Second Embodiment shown in (a) of FIG. 11. As the shape of the retaining portion 18*e*, various shapes for permitting easy insertion of the fixing shaft portion 18*a* into the fastening hole 16*d* may appropriately be used when the edge portion of the fastening hole 16*d* is caused to ride over the retaining portion 18*e* by being expanded based on its elastic deformation.

Other constitutions are the same as those in the above-described embodiments, and a similar effect can be obtained.

Fourth Embodiment

Next, with reference to FIG. 12, a developer accommodating unit according to the present invention in a constitution in this embodiment will be described. Incidentally, constituent elements similar to those in the above-described embodiments are partly represented by the same reference numerals or symbols and are partly represented by different reference numerals or symbols, and will be omitted from redundant description.

Part (a) of FIG. 12 is a schematic view of left and right retaining portions 218*l* and 218*r* of a developer accommodating unit 25 in this embodiment as seen by projecting the retaining portions on a plane perpendicular to an axis 218*d* of a fixing shaft portion 218*a*. At that time, a distance from an outer end portion 218*i* of a rectilinear locking edge line 218*f* outside an edge portion of a fastening hole 216*d* to the first bonding portion 22*a* is smaller than a distance from a locking portion 218*h*, where the edge portion of the fastening hole 216*d* is locked, to the first bonding portion 22*a*. Part (b) and (c) of FIG. 12 are partly enlarged views of (a) of FIG. 12.

In the above-described embodiments, the retaining portion 18*e* having the outer configuration larger than the diameter of the edge portion of the fastening hole 16*d* provided at the plurality of positions was provided. Further, an example in which the locking edge line 18*f* was provided in each of sides of the fixing shaft portion 18*a* shown in FIGS. 6 and 11 with respect to the arrow F direction was described.

In this embodiment, as shown in FIG. 12, the fastening hole 216*d* having a perfect circular shape is provided at a lock of positions of the developing bag 16. Trapezoidal retaining portions 218*l* and 218*r* each having the outer configuration larger than the diameter of the fastening hole 216*d* are provided in a projected state in the left and right sides, respectively, of the fixing shaft portion 218*a* provided in each of the plurality of the fastening holes 216*d*. By the retaining portions 218*l* and 218*r*, the edge portions of the fastening holes 216*d* are prevented from being disengaged from the fixing shaft portions 218*a*.

In this embodiment, as shown in (a) of FIG. 12, the plurality of the fixing shaft portions 218*a* are provided. Of these fixing shaft portions 218*a*, with respect to the fixing shaft portions 218*a* at end portions with respect to the arrow F direction of (a) of FIG. 12, the retaining portion 218*l* and 218*r* for the fixing shaft portions are disposed outside in a projected state in left and right sides, respectively, of the fixing shaft portions 218*a* with respect to the arrow F direction of (a) of FIG. 12. At an intermediary portion with respect to the arrow F direction of (a) of FIG. 12, the retaining portions 218*l* and 218*r* for the fixing shaft portions 218*a* are disposed outside in a projected state in left and right sides, respectively, of the fixing shaft portions 218*a* with respect to the arrow F direction of (a) of FIG. 12. The retaining portions 218*l* and 218*r* are disposed so that the number of the left-side retaining portions 218*l* is equal to the number of the right-side retaining portions 218*r*.

As shown in (a) of FIG. 12, in this embodiment, the sealing member 19 is unsealed. At that time, a shape of a rectilinear locking edge line 218*f* of each of the retaining portions 218*l* and 218*r* for locking the edge portions of the fastening holes 216*d* is similar to those in the above-described embodiments. That is, when each of the retaining portions 218*l* and 218*r* is projected on a plane perpendicular to the axis 218*d* of the fixing shaft portion 218*a*, a distance to the first bonding portion 22*a* from the outer end portion 218*i* outside the edge portion of the fastening hole 216*d* on the locking edge line 218*f* is smaller than a distance to the first bonding portion 22*a* from the locking portion 218*h* where the edge portion of the fastening hole 216*d* is locked.

By providing the retaining portions 218*l* and 218*r* projected to left and right outsides, respectively, of outer diameter portions of the fixing shaft portions 218*a*, positions where the developing bag 16 is locked at the end portions with respect to the arrow F direction of (a) of FIG. 12 can be constituted substantially similarly as in the above-described embodiments.

Further, the retaining portions 218*l* projected leftward from the fixing shaft portions 218*a* with respect to the arrow F direction of (a) of FIG. 12 and the retaining portions 218*r* projected rightward from the fixing shaft portions 218*a* with respect to the arrow F direction of (a) of FIG. 12 are disposed in the same manner and alternately with respect to the arrow F direction of (a) of FIG. 12.

As a result, as shown in (b) and (c) of FIG. 12, moving forces M1 for moving the edge portions of the fastening holes 216*d* from the outer end portions 218*i* toward the locking portions 218*h* along the locking edge lines 218*f* of the retaining portions 218*l* and 218*r* projected to the left and right outsides, respectively, of the outer diameter portions of the fixing shaft portions 218*a* can be cancelled with each other with respect to the left-right direction. Further, a force for shifting the developing bag 16 in one side with respect to the arrow F direction of (a) of FIG. 12 is not generated. Other constitutions are the same as those in the above-described embodiments, and a similar effect can be obtained.

Fifth Embodiment

Next, with reference to (a) to (c) of FIG. 13, a developer accommodating unit according to the present invention in a constitution in this embodiment will be described. Incidentally, constituent elements similar to those in the above-described embodiments are represented by the same reference numerals or symbols and will be omitted from description.

Part (a) of FIG. 13 is a schematic view of left and right retaining portions 218*l* and 218*r* of a developer accommodating unit 25 in this embodiment as seen by projecting the retaining portions on a plane perpendicular to an axis 218*d* of a fixing shaft portion 218*a*, and is an illustration showing a state in which an outer end portion 218*i* of a locking edge line 218*f* outside an edge portion of a fastening hole 216*d* has a distance closer to the first bonding portion 22*a* than a locking portion 218*h* where the edge portion of the fastening hole 216*d* is locked, and (b) and (c) of FIG. 13 are partly enlarged views of (a) of FIG. 13.

In Fourth Embodiment described above, the retaining portions 218*l* projected leftward from the fixing shaft portions 218*a* with respect to the arrow F direction of (a) of FIG. 12 are provided. Further, the retaining portions 218*r* projected rightward from the fixing shaft portions 218*a* with respect to the arrow F direction of (a) of FIG. 12. Further, the retaining portions 218*l* and 218*r* are disposed alternately with respect to the arrow F direction of (a) of FIG. 12.

In this embodiment, as shown in (a) of FIG. 13, with respect to the arrow F direction of (a) of FIG. 13, the retaining portions 218*l* projected leftward from the fixing shaft portions 218*a* are disposed from a central portion to a left-side end portion of the developing bag 16. Further, the retaining portions 218*r* projected rightward from the fixing shaft portions 218*a* are disposed from the central portion to a right-side end portion of the developing bag 16.

Further, the left-side retaining portions 218*l* of (a) of FIG. 13 and the right-side retaining portions 218*r* of (a) of FIG. 13 are disposed in the same number. In this case, as shown in (b) and (c) of FIG. 13, moving forces M1 for moving the edge portions of the fastening holes 216*d* from the outer end portions 218*i* toward the locking portions 218*h* along the locking edge lines 218*f* of the retaining portions 218*l* and 218*r* projected to the left and right outsides, respectively, of the outer diameter portions of the fixing shaft portions 218*a* can be cancelled with each other with respect to the left-right direction. Further, a force for shifting the developing bag 16 in one side with respect to the arrow F direction of (a) of FIG. 13 is not generated. Other constitutions are the same as those in the above-described embodiments, and a similar effect can be obtained.

Sixth Embodiment

Next, with reference to (d) and (e) of FIG. 13, a developer accommodating unit according to the present invention in a constitution in this embodiment will be described. Incidentally, constituent elements similar to those in the above-described embodiments are represented by the same reference numerals or symbols and will be omitted from description.

Part (d) of FIG. 13 is a schematic view of left and right retaining portions 218*l* and 218*r* of a developer accommodating unit 25 in this embodiment as seen by projecting the retaining portions on a plane perpendicular to an axis 218*d* of a fixing shaft portion 218*a*, and is an illustration showing a state in which an outer end portion 218*i* of a locking edge line 218*f* outside an edge portion of the rectangular fastening hole 216*d* has a distance closer to the first bonding portion 22*a* than a locking portion 218*h* where the edge portion of the fastening hole 216*d* is locked, and (e) of FIG. 13 is a partly enlarged view of (a) of FIG. 13.

In the above-described embodiments, with respect to all of the fixing shaft portions 18*a* and 218*a*, the fastening holes 16*d* and 216*d* were provided, respectively. In this embodiment, with respect to each of pairs of left and right retaining portions 218*l* and 218*r* which are disposed adjacently to each other, a single rectangular fastening hole 216*d* is provided.

As shown in (d) of FIG. 13, the retaining portions 218*l* projected leftward from the fixing shaft portions 218*a* with respect to the arrow F direction of (d) of FIG. 13 are provided. Further, the retaining portions 218*r* projected rightward from the fixing shaft portions 218*a* with respect to the arrow F direction of (d) of FIG. 13. Further, the retaining portions 218*l* and 218*r* are disposed alternately with respect to the arrow F direction of (d) of FIG. 13. Further, the pair of left and right retaining portions 218*l* and 218*r* is disposed adjacently to each other. Further, the pair of left and right retaining portions 218*l* and 218*r* is inserted into the single rectangular fastening hole 216*d*, so that the edge portion of the fastening hole 216*d* is prevented from being disengaged from the fixing shaft portions 218*a*.

In this embodiment, there is no need to provide the fastening holes 216*d* with respect to all of the fixing shaft portions 218*a* one by one, so that tensile strength of the developing bag 16 can be improved. Other constitutions are the same as those in the above-described embodiments, and a similar effect can be obtained.

Seventh Embodiment

Next, with reference to FIGS. 14 to 16, a developer accommodating unit according to the present invention in a constitution in this embodiment will be described. Incidentally, constituent elements similar to those in the above-described embodiments are partly represented by the same reference numerals or symbols and are partly represented by different reference numerals or symbols, and will be omitted from redundant description.

FIG. 14 is a perspective illustration showing a state in which in a developer accommodating unit 25 in this embodiment, an outer end portion 318*i*, of a locking edge line 318*f* of a retaining portion 318*e*, outside an edge portion of a fastening hole 316*d*, is projected toward the fastening hole 316*d*, with respect to a direction of an axis 318*d* of a fixing shaft portion 318*a*, more than a locking portion 318*h*. The locking portion 318*h* is a portion where the edge portion of the fastening hole 316*d* is locked.

FIG. 15 is an illustration showing a state of the retaining portion 318*e* in this embodiment as seen by projecting the retaining portion 318*e* on a plane perpendicular to the axis 318*d* of the fixing shaft portion 318*a*. FIG. 16 is a sectional illustration showing a state in which, the outer end portion 318*i*, of the locking edge line 318*f* of the retaining portion 318*e*, outside the edge portion of the fastening hole 316*d* is projected toward the fastening hole 316*d*, with respect to the direction of the axis 318*d* of the fixing shaft portion 318*a*, more than the locking portion 318*h* where the edge portion of the fastening hole 316*d* is locked in this embodiment.

In the above-described embodiments, the sealing member 19 is unsealed as shown in FIG. 7. At that time, the locking edge lines 18*f*, 218*f* and 318*f* of the retaining portions 18*e*, 218*l*, 218*r* and 318*e* for locking the edge portions of the fastening holes 16*d*, 216*d* and 316*d* are considered.

In this case, on the locking edge lines 18*f*, 218*f* and 318*f*, the outer end portions 18*i*, 218*i* and 318*i* and the locking portions 18*h*, 218*h* and 318*h* were disposed on the same plane with respect to the directions of the axes 18*d*, 218*d* and 318*d* of the fixing shaft portions 18*a*, 218*a* and 318*a*. The outer end portions 18*i*, 218*i* and 318*i* are the outermost portions disposed unseal the edge portions of the fastening holes 16*d*, 216*d* and 316*d* on the locking edge lines 18*f*, 218*f* and 318*f*. The locking portions 18*h*, 218*h* and 318*h* are portions where the edge portions of the fastening holes 16*d*, 216*d* and 316*d* are locked.

In this embodiment, as shown in FIGS. 14 and 16, the locking edge line 318*f* of the retaining portion 318*e* for preventing the edge portion of the fastening hole 316*d* having an elliptical shape from being disengaged from the fixing shaft portion 318*a* by locking the edge portion of the fastening hole 316*d* provided in the developing bag 16 when the sealing member 19 is unsealed is considered. A constitution in which on the locking edge line 318*f*, the outer end portion 318*i* is projected toward the fastening hole 316*d* side (lower side in FIG. 16) with respect to the direction of the axis 318*d* of the fixing shaft portion 318*a*, more than the locking portion 318*h* where the edge portion of the fastening hole 316*d* is locked is employed. The outer end portion 318*i* is the outermost portion disposed outside of the edge portion of the fastening hole 316*d* on the locking edge line 318*f*.

In the above-described embodiments, as shown in FIGS. 6, 10 and 11 to 13, the retaining portions 18*e*, 218*l*, 218*r* and 318*e* are projected on the planes perpendicular to the axes 18*d*, 218*d* and 318*d* of the fixing shaft portions 18*a*, 218*a* and 318*a*.

At that time, the locking edge lines 18*f*, 218*f* and 318*f* of the retaining portions 18*e*, 218*l*, 218*r* and 318*e* for locking the edge portions of the fastening holes 16*d*, 216*d* and 316*d* when the sealing member 19 is unsealed are considered.

In this case, on the locking edge lines 18*f*, 218*f* and 318*f*, the outer end portions 18*i*, 218*i* and 318*i* were disposed closer to the first bonding portion 22*a* than the locking portions 18*h*, 218*h* and 318*h* where the edge portions of the fastening holes 16*d*, 216*d* and 316*d* were locked. The outer end portions 18*i*, 218*i* and 318*i* are the outermost portions disposed outside of the edge portions of the fastening holes 16*d*, 216*d* and 316*d* on the locking edge lines 18*f*, 218*f* and 318*f*.

As a result, the developing bag 16 is pulled via the sealing member 19. Then, the edge portions of the fastening holes 16*d*, 216*d* and 316*d* receive the moving forces M1 directed, along the locking edge lines 18*f*, 218*f* and 318*f*, from the outer end portions 18*i*, 218*i* and 318*i* toward the locking portions 18*h*, 218*h* and 318*h*. The outer end portions 18*i*, 218*i* and 318*i* are the outermost portions disposed outside of the edge portions of the fastening holes 16*d*, 216*d* and 316*d* on the locking edge lines 18*f*, 218*f* and 318*f*.

By these moving forces M1, the edge portions of the fastening holes 16*d*, 216*d* and 316*d* are shifted toward the locking portions 18*h*, 218*h* and 318*h*. For this reason, the edge portions of the fastening holes 16*d*, 216*d* and 316*d* are not disengaged from the retaining portions 18*e*, 218*l*, 218*r* and 318*e*, so that it is possible to stably realize the unsealing of the openings 35*a* of the developing bag 16.

In this embodiment, as shown in FIG. 15, the retaining portion 318*e* is projected on the plane perpendicular to the axis 318*d* of the fixing shaft portion 318*a*.

At that time, the locking edge line 318*f* of the retaining portion 318*e* for locking the edge portion of the fastening hole 316*d* when the sealing member 19 is unsealed are considered. On the locking edge line 318*f*, the outer end portion 318*i*, outside the edge portion of the fastening hole 316*d* on the locking edge line 318*f*, was disposed remoter from the first bonding portion 22*a* than the locking portion 318*h* where the edge portion of the fastening hole 316*d* was locked.

As shown in FIG. 15, the unsealing member 20 is rotated about the rotation axis 20*d*, so that the sealing member 19 is pulled via the sealing member 19. Then, the edge portion of the fastening hole 316*d* receives a moving force M2 directed, with respect to the direction of the axis 318*d* of the fixing shaft portion 318*a*, from the locking portion 318*h*, where the edge portion of the fastening hole 316*d* is locked, toward the direction of the outer end portion 318*i* outside the edge portion of the fastening hole 316*d* on the locking edge line 318*f*. On the other hand, with respect to a direction perpendicular to the axis 318*d* of the fixing shaft portion 318*a*, as shown in FIG. 16, the edge portion of the fastening hole 316*d* receives a moving force N directed from the outer end portion 318*i*, outside the edge portion of the fastening hole 316*d* on the locking edge line 318*f*, toward the locking portion 318*h* where the edge portion of the fastening hole 316*d* is locked.

By the moving force N described above, a force for shifting the edge portion of the fastening hole 316*d* toward the fixing shaft portion 318*a* along the locking edge line 318*f* acts on the edge portion of the fastening hole 316*d*. Further, as described above with reference to FIG. 15, the edge portion of the fastening hole 316*d* receives the moving force M2 directed from the locking portion 318*h* toward the outer end portion 318*i* along the locking edge line 318*f*. However, the edge portion of the fastening hole 316*d* is not disengaged from the retaining portion 318*e*. As a result, it is possible to stably realize the unsealing of the openings 35*a* of the developing bag 16. Other constitutions are the same as those in the above-described embodiments, and a similar effect can be obtained.

Eighth Embodiment

Next, with reference to FIG. 17, a developer accommodating unit according to the present invention in a constitution in this embodiment will be described. Incidentally, constituent elements similar to those in the above-described embodiments are partly represented by the same reference numerals or symbols and are partly represented by different reference numerals or symbols, and will be omitted from redundant description.

FIG. 17 is a schematic view of a retaining portion 418*e* of a developer accommodating unit 25 in this embodiment as seen by projecting the retaining portion 418*e* on a plane perpendicular to an axis 418*d* of a fixing shaft portion 418*a*, and is an illustration showing a state in which an outer end portion 418*i* of a locking edge line 418*f* outside an edge portion of a fastening hole 416*d* has a distance closer to the first bonding portion 22*a* than a locking portion 418*h* where the edge portion of the fastening hole 416*d* is locked.

In Seventh Embodiment described above, as shown in FIG. 15, the retaining portion 318*e* is projected on the plane perpendicular to the axis 318*d* of the fixing shaft portion 318*a*.

At that time, the locking edge line 318*f* of the retaining portion 318*e* for locking the edge portion of the fastening hole 316*d* when the sealing member 19 is unsealed are considered. On the locking edge line 318*f*, the outer end portion 318*i*, outside the edge portion of the fastening hole 316*d* on the locking edge line 318*f*, was disposed remoter from the first bonding portion 22*a* than the locking portion 318*h* where the edge portion of the fastening hole 316*d* was locked.

In this embodiment, as shown in FIG. 17, the retaining portion 418*e* is projected on the plane perpendicular to the axis 418*d* of the fixing shaft portion 418*a*.

At that time, the locking edge line 418*f* of the retaining portion 418*e* for locking the edge portion of the fastening hole 416*d* when the sealing member 19 is unsealed are considered. On the locking edge line 418*f*, the outer end portion 418*i* is disposed downstream (in an upper side in FIG. 17) of the locking portion 418*h*, where the edge portion of the fastening hole 416*d* is locked, with respect to the unsealing direction of the sealing portion 19*a*, and is disposed closer to the first bonding portion 22*a* than the locking portion 418*h*. The outer end portion 418*i* is the outermost portion disposed outside the edge portion of the fastening hole 416*d* on the locking edge line 418*f*.

As a result, the developing bag 16 is pulled via the sealing member 19. Then, the edge portion of the fastening hole 416*d* receives a moving force M1 directed, along the locking edge line 418*f*, from the locking portion 418*h*, outside the edge portion of the fastening hole 416*d* on the locking edge line 418*f*, toward the locking portion 418*h* where the edge portion of the fastening hole 416*d* is locked. By the moving force M1, the edge portion of the fastening hole 416*d* is shifted toward the locking portion 418*h*. For this reason, even in a direction perpendicular to the axis 418*d* of the fixing shaft portion 418*a*, a force for engaging the edge portion of the fastening hole 416*d* from the retaining portion 418*e* is not generated. As a result, it is possible to stably realize the unsealing of the openings 35*a* of the developing bag 16.

Also in this embodiment, similarly as in Seventh Embodiment described above, the locking edge line 148*f* of the retaining portion 148*e* for preventing the edge portion of the elliptical fastening hole 416*d* from being disengaged from the fixing shaft portion 418*a* by locking the edge portion of the fastening hole 416*d* provided in the developing bag 16 when the sealing member 19 is unsealed is considered. A constitution in which on the locking edge line 148*f*, the outer end portion 148*i* is projected toward the fastening hole 416*d*, with respect to the direction of the axis 418*d* of the fixing shaft portion 418*a*, more than the locking portion 418*h* where the edge portion of the fastening hole 416*d* is locked. The outer end portion 418*i* is the outermost portion disposed outside the edge portion of the fastening hole 416*d* on the locking edge line 418*f*.

In this embodiment, the retaining portion 418*e* is projected on the plane perpendicular to the axis 418*d* of the fixing shaft portion 418*a*. A distance from the outer end portion 418*i* to the first bonding portion 22*a* which is a downstream end portion of the unsealing direction is smaller than a distance from the locking portion 418*h*, where the edge portion of the fastening hole 416*d* is contacted, to the first bonding portion 22*a*. The outer end portion 418*i* is the outermost portion outside the edge portion of the fastening hole 416*d* on the locking edge line 418*f*.

In another constitution, as described later with reference to FIG. 19, the outer end portion 418*i* and the locking portion 418*d* where the edge portion of the fastening hole 416*d* may also be disposed on the same line perpendicular to the pulling direction (arrow L direction of FIG. 17) of the edge portion of the fastening hole 416*d*. In this case, the outer end portion 418*i* is the outermost portion disposed outside the edge portion of the fastening hole 416*d* on the locking edge line 418*f*.

Further, the locking edge line 418*f* has a shape of a rectilinear line connecting the locking portion 418*h*, where the edge portion of the fastening hole 416*d*, with the outer end portion 418*i* outside the edge portion of the fastening hole 416*d* on the locking edge line 418*f*. As another constitution, similarly as in Second Embodiment described above with reference to (a) of FIG. 11, the locking edge line 418*f* may also have a curved shape. Other constitutions are the same as those in the above-described embodiments, and a similar effect can be obtained.

Ninth Embodiment

Next, with reference to FIGS. 18 to 20, a developer accommodating unit according to the present invention in a constitution in this embodiment will be described. Incidentally, constituent elements similar to those in the above-described embodiments are partly represented by the same reference numerals or symbols and are partly represented by different reference numerals or symbols, and will be omitted from redundant description.

FIG. 18 is a perspective illustration showing a state in which in a developer accommodating unit 25 in this embodiment, an outer end portion 518*i* outside an edge portion of a fastening hole 516*d* is projected toward the fastening hole, with respect to a direction of an axis 518*d* of a fixing shaft portion 518*a*, more than a locking portion 518*h* where the edge portion of the fastening hole 516*d* is locked. The outer end portion 518*i* is the outermost portion disposed outside the edge portion of the fastening hole 516*d* on the locking edge line 518*f*.

FIG. 19 is a schematic view of a retaining portion 518*e* in this embodiment as seen by projecting the retaining portion 518*e* on a plane perpendicular to an axis 518*d* of a fixing shaft portion 518*a*. At that time, an outer end portion 518*i* of a locking edge line 518*f* outside an edge portion of a fastening hole 516*d* and a locking portion 518*h* where the edge portion of the fastening hole 516*d* is locked have the same distance to the first bonding portion 22*a*.

Further, the outer peripheral surface of the fixing shaft portion 518*a* and the locking edge line 518*f* of the retaining portion 518*e* contact each other.

FIG. 20 is a sectional illustration showing a state in which an outer end portion 518*i* of a retaining portion 518*e* is projected toward the fastening hole 516*d*, with respect to a direction of an axis 518*d* of a fixing shaft portion 518*a*, more than a locking portion 518*h* where the edge portion of the fastening hole 516*d* is locked in this embodiment. The outer end portion 518*i* is the outermost portion disposed outside the edge portion of the fastening hole 516*d* on the locking edge line 518*f*.

As shown in FIGS. 18 to 20, in this embodiment, the locking edge line 518*f* of the retaining portion 518*e* for preventing the edge portion of the fastening hole 516*d* from being disengaged from the fixing shaft portion 518*a*, which is provided to stand at the inner surface of the second frame 18 and which is fixed by being inserted into the fastening hole 516*d* provided in the developing bag 16 is considered. The locking edge line 518*f* is projected on a plane perpendicular to the axis 518*d* of the fixing shaft portion 518*a*.

At that time, on the locking edge line 518*f* of the retaining portion 518*e* for locking the edge portion of the fastening hole 516*d* when the sealing member 19 is unsealed, the outer end portion 518*i* and the locking portion 518*h* are disposed in positions such that these portions are aligned with each other in a direction perpendicular to the pulling direction (arrow L direction of FIG. 19) of the edge portion of the fastening hole 516*d*. Further, a constitution in which a distance from the outer end portion 518*i* to the first bonding portion 22*a* is equal to a distance from the locking portion 518*h* to the first bonding portion 22*a* is employed. The outer end portion 518*i* is the outermost portion disposed outside the edge portion of the fastening hole 516*d* on the locking edge line 518*f*. The locking portion 518*h* is the portion where the edge portion of the fastening hole 516*d* is locked.

Further, as shown in FIG. 19, the outer peripheral surface of the fixing shaft portion 518*a* and the locking edge line 518*f* of the retaining portion 518*e* contact each other. That is, on a rectilinear line connecting the two locking portions 518*h* on the locking edge line 518*f* of the retaining portion 518*e* where the edge portion of the fastening hole 516*d* is locked, there is a contact point 518*n* with the outer peripheral surface of the fixing shaft portion 518*a*.

A constitution in which, at a portion where the edge portion of the fastening hole 516*d* is movable, in an upstream side (rear side) of the locking edge line 518*f* of the retaining portion 518*e* with respect to the arrow L direction of FIG. 19, the fixing shaft portion 518*a* is provided with a projected portion 518*p* having a distance, from the first bonding portion 22*a*, larger (remoter) than the retaining portion 518*e* is employed. That is, the outer peripheral surface of the fixing shaft portion 518*a* is projected, relative to the retaining portion 518*e*, toward the upstream side with respect to the arrow L direction. As a result, a length of the retaining portion 518*e* with respect to the arrow L direction of FIG. 19 is smaller than an outer diameter of the fixing shaft portion 518*a*.

First, an effect that the distance to the first bonding portion 22*a* from the locking portion 518*h* where the edge portion of the fastening hole 516*d* is locked and the distance to the first bonding portion 22*a* from the outer end portion 518*i* outside the edge portion of the fastening hole 516*d* on the locking edge line 518*f* are equal to each other as shown in FIG. 19 will be described.

The edge portion of the fastening hole 516*d* is expanded so as to ride over the retaining portion 518*e* by its elastic deformation, so that the fixing shaft portion 518*a* is inserted into the fastening hole 516*d*. In this case, the constitution is compared with a constitution in the case where the distance to the first bonding portion 22*a* is smaller at the outer end portion 518*i*, outside the edge portion of the fastening hole 516*d* on the locking edge line 518*f*, than at the locking portion 518*h* where the edge portion of the fastening hole 516*d* is locked. Then, an amount of the elastic deformation of the edge portion of the fastening hole 516*d* can be suppressed at a low level, so that it is possible to easily perform an assembling operation of the fastening hole 516*d* with the fixing shaft portion 518*a*.

Next, an effect in the case where the contact point 518*n* where the outer peripheral surface of the fixing shaft portion 518*a* and the locking edge line 518*f* of the retaining portion 518*e* contact each other and the projected portion 518*p* having the larger distance, from the first bonding portion 22*a*, than the retaining portion 518*e* will be described.

The fixing shaft portion 518*a* has the contact point 518*n* and the projected portion 518*p*. As a result, when the fastening hole 516*d* is assembled with the fixing shaft portion 518*a*, with respect to the arrow L direction of FIG. 19, it is possible to form a shape such that a minimum spacing is formed between the fastening hole 516*d* and the fixing shaft portion 518*a* without being influenced by the shape of the retaining portion 518*e*.

As a result, it is possible to minimize an amount of movement of the developing bag 16 in the arrow L direction of FIG. 19 during the unsealing of the sealing member 19. As a result, it is possible to realize satisfactory unsealing of the openings 35*a* of the developing bag 16.

Further, the fastening hole 516*d* is assembled with the fixing shaft portion 518*a*. At that time, a portion of the retaining portion 518*e* excluding the locking edge line 518*f* is made small in shape. As a result, during the assembling of the fastening hole 516*d* with the fixing shaft portion 518*a*, the elastic deformation amount of the edge portion of the fastening hole 516*d* can be suppressed at a low level. As a result, it is possible to easily perform the assembling operation of the fastening hole 516*d* with the fixing shaft portion 518*a*.

In this way, when the retaining portion 518*e*, the fixing shaft portion 518*a* and the fastening hole 516*d* in this embodiment are used, it is possible to minimize an amount of relative change in positional relationship between the developer supplying roller 23 and the openings 35*a*. Further, the assembling operation of the fastening hole 516*d* with the fixing shaft portion 518*a* can be easily performed.

As shown in FIG. 19, the locking edge line 518*f* is projected on the plane perpendicular to the axis 518*d* of the fixing shaft portion 518*a*. At that time, on the locking edge line 518*f*, the locking portion 518*h* where the edge portion of the fastening hole 516*d* is locked and the outer end portion 518*i* outside the edge portion of the fastening hole 516*d* are disposed on the same rectilinear line. With respect to a direction of the axis 518*d* of the fixing shaft portion 518*a* shown in FIG. 20, a force for moving the edge portion of the fastening hole 516*d* from the locking portion 518*h*, where the edge portion of the fastening hole 516*d* is locked, toward the outer end portion 518*i* outside the edge portion of the fastening hole 516*d* on the locking edge line 518*f* is not generated. As a result, it is possible to stably realize the unsealing of the openings 35*a* of the developing bag 16.

In this embodiment, an example in which the fixing shaft portion 518*a* is provided with the contact point 518*n* and the projected portion 518*p* is described, but even in the case where only the contact point 518*n* is provided, such an effect that the assembling operation can be easily performed can be obtained.

Incidentally, as shown in FIGS. 18 and 20, the outer end portion 518*i* of the retaining portion 518*e* is projected, toward the fastening hole 516*d* (the lower side of FIGS. 18 and 20) with respect to the direction of the axis 518*d* of the fixing shaft portion 518*a*, more than the locking portion 518*h* where the edge portion of the fastening hole 516*d* is locked. The outer end portion 518*i* is the outermost portion disposed outside the edge portion of the fastening hole 516*d* on the locking edge line 518*f*. Other constitutions are the same as those in the above-described embodiments, and a similar effect can be obtained.

Tenth Embodiment

Next, with reference to FIG. 21, a developer accommodating unit according to the present invention in a constitution in this embodiment will be described. Incidentally, constituent elements similar to those in the above-described embodiments are represented by the same reference numerals or symbols and will be omitted from description.

FIG. 21 is a schematic view of a retaining portion 518*e* of the developer accommodating unit 25 in this embodiment as seen by projecting the retaining portion 518*e* on a plane perpendicular to an axis 518*d* of a fixing shaft portion 518*a*. At that time, an outer end portion 518*i* of a locking edge line 518*f* outside an edge portion of a fastening hole 516*d* and a locking portion 518*h* where the edge portion of the fastening hole 516*d* is locked have the same distance to the first bonding portion 22*a*. Further, FIG. 21 is an illustration showing a state in which the outer peripheral surface of the fixing shaft portion 518*a* is projected from the locking edge line 518*f* of the retaining portion 518*e* toward front and rear sides (upstream and downstream sides) of the arrow L direction of FIG. 21 which is the direction where the fastening hole 516*d* is movable.

In Ninth Embodiment described above, as described above with reference to FIG. 19, the constitution in which the contact point 518*n* with the fixing shaft portion 518*a* is disposed on the rectilinear line connecting the pair of locking portions 518*h* where the edge portion of the fastening hole 516*d* is locked on the locking edge line 518*f* was employed.

In this embodiment, as shown in FIG. 21, the outer peripheral surface of the fixing shaft portion 518*a* is projected from the rectilinear line connecting the pair of locking portions 518*h* toward the front and rear sides (upstream and downstream sides) of the arrow L direction in FIG. 21. Further, a constitution in which a pair of intersection points 518*q* where the rectilinear line connecting the pair of locking portions 518*h* intersects with the outer peripheral surface of the fixing shaft portion 518*a* is provided is employed. The pair of locking portions 518*h* are portions where the edge portion of the fastening hole 516*d* is locked on the locking edge line 518*f* of the retaining portion 518*e*. The arrow L direction of FIG. 21 is a direction in which the edge portion of the fastening hole 516 is moved by rotating the unsealing member 20 about the rotation shaft 20*d* to pull the developing bag 16 via the sealing member 19.

Incidentally, this embodiment is constituted similarly as Ninth Embodiment described above with reference to FIGS. 18 and 20. That is, an outer end portion 518*i* of a retaining portion 518*e* is projected toward the fastening hole 516*d* with respect to a direction of an axis 518*d* of a fixing shaft portion 518*a*, more than a locking portion 518*h* where the edge portion of the fastening hole 516*d* is locked. Other constitutions are the same as those in the above-described embodiments, and a similar effect can be obtained.

Eleventh Embodiment

Next, with reference to FIG. 22, a developer accommodating unit according to the present invention in a constitution in this embodiment will be described. Incidentally, constituent elements similar to those in the above-described embodiments are represented by the same reference numerals or symbols and will be omitted from description.

In the above-described embodiments, the example of the developing bag 16 as the flexible container accommodating the developer and provided with the openings 35*a* for permitting discharge of the developer was described. In this embodiment, as the flexible container accommodating the developer and provided with the openings 35*a* for permitting discharge of the developer, a developer accommodating member 34 is used.

As shown in FIG. 22, the developer accommodating container 30 including the unsealing member 20 is constituted, similarly as in the above-described embodiments, by the developer accommodating member 34, the sealing member 19, the unsealing member 20, the first frame 17, the second frame 18 and the like.

<Developer Accommodating Member>

In FIG. 22, the developer accommodating member 34 includes a container body portion 34*a* which is a flexible container manufactured by subjecting a sheet-like material to vacuum molding, air-pressure molding, press molding, insertion molding or the like. Further, the developer accommodating member 34 includes a sheet portion 34*b*, having flexibility, for covering the container body portion 34*a* in an opening side. Bonding between the container body portion 34*a* and the sheet portion 34*b* is made by using (thermal) welding, laser welding, an adhesive, an adhesive tape, or the like.

As a material for the container body portion 34*a*, it is possible to use an acrylonitrile butadiene styrene copolymer (ABS) and polymethylmethacrylate (PMMA). Further, it is also possible to use polycarbonate (PC), polypropylene (PP), polyethylene (PE), high-impact polystyrene (HIPS), polyethylene terephthalate (PET), polyvinyl chloride (PVC), and composite multi-layer materials of these polymers.

Incidentally, the high-impact polystyrene (HIPS) is prepared by adding a rubber-like polymer or a rubber-like copolymer to polystyrene (PS). The rubber-like polymer or copolymer is selected from the group consisting of polybutadiene, styrene-butadiene copolymer, polyisoprene, butadiene-isoprene copolymer, natural rubber, and ethylene-propylene copolymer.

A thickness of the container body portion 34*a* may preferably be 0.1 mm to 1 mm as a thickness of the sheet-like member before the molding since the resultant portion is excellent in flexibility. The material and the thickness of the container body portion 34*a* can be appropriately be set depending on cost, product specifications, manufacturing condition, and the like.

Incidentally, even when the developer accommodating member 34 in this embodiment is used in place of the developing bag 16 used in the above-described embodiments, effects similar to those in the above-described embodiments can be obtained. Other constitutions are the same as those in the above-described embodiments, and a similar effect can be obtained.

According to the present invention, in the developer accommodating unit using the flexible container for accommodating the developer, it is possible to fix the flexible container on the frame by a simple method, so that it is possible to reliably unseal the sealing portion, for sealing the openings of the flexible container, by the movement of the sealing member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 198090/2012 filed Sep. 10, 2012, which is hereby incorporated by reference.

What is claimed is:

1. A developer accommodating unit for accommodating developer, said developer accommodating unit comprising:

a flexible container, provided with an opening for permitting discharge of the developer, for accommodating the developer; and a frame, wherein said flexible container is provided with a fastening hole for fastening said flexible container in said frame, wherein said frame includes (i) a fixing shaft portion fixed in the fastening hole by being inserted into the fastening hole and (ii) a retaining portion for preventing said fixing shaft portion from being disengaged from the fastening hole, and wherein when said fixing shaft portion is inserted into the fastening hole, the fastening hole rides over said retaining portion by being expanded based on elastic deformation thereof.

2. A developer accommodating unit according to claim 1, further comprising a sealing member, which includes a sealing portion for sealing the opening and which is mounted on said flexible container, capable of exposing the opening by being moved.

3. A developer accommodating unit according to claim 2, further comprising an unsealing member for moving said sealing member.

4. A developer accommodating unit according to claim 3, wherein said frame accommodates said unsealing member.

5. A developer accommodating unit according to claim 1, wherein when said retaining portion is projected on a plane perpendicular to an axis of said fixing shaft portion, on a locking edge line of said retaining portion for locking an edge portion of the fastening hole when a sealing member is unsealed, an outer end portion of the locking edge line outside of said edge portion of the fastening hole is provided downstream, with respect to a predetermined direction, of a locking portion where said edge portion of the fastening hole is locked or is provided at a position where said outer end portion is aligned with said locking portion in a direction perpendicular to the predetermined direction.

6. A developer accommodating unit according to claim 1, wherein on a locking edge line of said retaining portion for locking said edge portion of the fastening hole when a sealing member is unsealed, an outer end portion of the locking edge line outside of said edge portion of the fastening hole is projected toward the fastening hole, with respect to an axial direction of said fixing shaft portion, more than a locking portion where said edge portion of the fastening hole is locked.

7. A process cartridge comprising:

a developer accommodating unit according to claim 1, and an image bearing member for bearing a toner image.

8. An image forming apparatus for forming an image on a sheet by using developer, said image forming apparatus comprising:

a process cartridge according to claim 7, wherein said process cartridge is detachably mountable to said image forming apparatus.

9. A developing device comprising:

a developer accommodating unit according to claim 1.

10. A developer accommodating unit for accommodating developer, said developer accommodating unit comprising:

a flexible container, provided with an opening for permitting discharge of the developer, for accommodating the developer;

a sealing member that includes a sealing portion for sealing the opening and is mounted on said flexible container, said sealing member being capable of exposing the opening by being moved;

an unsealing member for moving said sealing member; and a frame for accommodating said unsealing member, wherein said flexible container is provided with a fastening hole for fastening said flexible container in said frame, wherein said frame includes (i) a fixing shaft portion fixed in the fastening hole by being inserted into the fastening hole and (ii) a retaining portion for preventing said fixing shaft portion from being disengaged from the fastening hole, wherein the fastening hole (i) is locked by fitting the fastening hole around said fixing shaft portion while an edge portion of the fastening hole rides over said retaining portion by elastic deformation thereof and (ii) is pulled in a predetermined direction when said sealing member is unsealed, and wherein, when said retaining portion is projected on a plane perpendicular to an axis of said fixing shaft portion, on a locking edge line of said retaining portion for locking said edge portion of the fastening hole when said sealing member is unsealed, an outer end portion of the locking edge line outside of said edge portion of the fastening hole is provided downstream, with respect to the predetermined direction, of a locking portion where said edge portion of the fastening hole is locked or is provided at a position where said outer end portion is aligned with said locking portion in a direction perpendicular to the predetermined direction.

11. A developer accommodating unit according to claim 10, wherein an outer end portion of the locking edge line outside of said edge portion of the fastening hole is projected toward the fastening hole, with respect to an axial direction of said fixing shaft portion, more than a locking portion where said edge portion of the fastening hole is locked.

12. A developer accommodating unit according to claim 10, wherein when said retaining portion is projected on a plane perpendicular to an axis of said fixing shaft portion, on a locking edge line of said retaining portion for locking said edge portion of the fastening hole when a sealing member is unsealed, said retaining portion is provided at a position where an outer end portion of the locking edge line outside of said edge portion of the fastening hole and a locking portion where said edge portion of the fastening hole is locked is aligned with each other in a direction perpendicular to the predetermined direction of said sealing member.

13. A developer accommodating unit according to claim 10, wherein an outer peripheral surface of said fixing shaft portion is projected toward an upstream side of said retaining portion with respect to the predetermined direction.

14. A process cartridge comprising:

a developer accommodating unit according to claim 10, and an image bearing member for bearing a toner image.

15. An image forming apparatus for forming an image on a sheet by using a developer, said image forming apparatus comprising:

a process cartridge according to claim 14, wherein said process cartridge is detachably mountable to said image forming apparatus.

16. A developing device comprising:

a developer accommodating unit according to claim 10.

17. A developer accommodating unit for accommodating developer, said developer accommodating unit comprising:

a flexible container, provided with an opening for permitting discharge of the developer, for accommodating the developer;

a sealing member that includes a sealing portion for sealing the opening and is mounted on said flexible container, said sealing member being capable of exposing the opening by being moved;

an unsealing member for moving said sealing member; and a frame for accommodating said unsealing member, wherein said flexible container is provided with a fastening hole for fixing said flexible container in said frame, wherein said frame includes (i) a fixing shaft portion fixed in the fastening hole by being inserted into the fastening hole and (ii) a retaining portion for preventing said fixing shaft portion from being disengaged from the fastening hole, wherein the fastening hole is locked by fitting the fastening hole around said fixing shaft portion while an edge portion of the fastening hole rides over said retaining portion by elastic deformation thereof, and wherein on a locking edge line of said retaining portion for locking said edge portion of the fastening hole when a sealing member is unsealed, an outer end portion of the locking edge line outside of said edge portion of the fastening hole is projected toward the fastening hole, with respect to an axial direction of said fixing shaft portion, more than a locking portion where said edge portion of the fastening hole is locked.

* * * * *